US009215914B2

(12) United States Patent
Strong

(10) Patent No.: US 9,215,914 B2
(45) Date of Patent: Dec. 22, 2015

(54) PORTABLE FOLDING CANOPY WITH MOVEABLE ELEMENT

(71) Applicant: Finn Alexander Strong, San Rafael, CA (US)

(72) Inventor: Finn Alexander Strong, San Rafael, CA (US)

( * ) Notice: Subject to any disclaimer, the term of this patent is extended or adjusted under 35 U.S.C. 154(b) by 0 days.

(21) Appl. No.: 14/589,865

(22) Filed: Jan. 5, 2015

(65) Prior Publication Data

US 2015/0181991 A1 Jul. 2, 2015

Related U.S. Application Data

(63) Continuation-in-part of application No. 14/304,875, filed on Jun. 13, 2014, now Pat. No. 8,926,394, which is a continuation-in-part of application No. 13/860,516, filed on Apr. 10, 2013, now Pat. No. 8,926,392, which is a continuation-in-part of (Continued)

(51) Int. Cl.

| | |
|---|---|
| ***A63H 33/00*** | (2006.01) |
| ***A45B 19/02*** | (2006.01) |
| ***A43B 3/00*** | (2006.01) |
| ***A45C 13/08*** | (2006.01) |
| ***A45C 13/28*** | (2006.01) |
| ***A45C 15/00*** | (2006.01) |
| ***A43B 23/24*** | (2006.01) |
| ***A45F 3/04*** | (2006.01) |

(Continued)

(52) U.S. Cl.

CPC ..... *A45B 19/02* (2013.01); *A43B 3/0078* (2013.01); *A43B 23/24* (2013.01); *A45B 25/00* (2013.01); *A45C 13/08* (2013.01); *A45C 13/28* (2013.01); *A45C 15/00* (2013.01); *A45F 3/04* (2013.01); *A63H 3/005* (2013.01); *A63H 3/06* (2013.01); *A45C 2200/00* (2013.01); *A45F 2003/003* (2013.01); *F15B 15/10* (2013.01)

(58) Field of Classification Search

CPC ..... A63H 3/00; A63H 3/06; A63H 3/48; A63H 3/52; A63H 33/00; A63H 2027/1075; A63H 2027/1033; A45B 19/00; A45B 19/02

USPC ..... 446/220–226; 135/20.2

See application file for complete search history.

(56) References Cited

U.S. PATENT DOCUMENTS

| | | | |
|---|---|---|---|
| 1,560,073 | A | 11/1925 | Bontempi et al. |
| 2,385,091 | A | 9/1945 | Lukowitz |

(Continued)

FOREIGN PATENT DOCUMENTS

| | | | |
|---|---|---|---|
| EP | 0524325 | A1 | 1/1993 |
| GB | 2437260 | A | 10/2007 |

(Continued)

OTHER PUBLICATIONS

"Monty Python Rabbit w/Big Pointy Teeth Plush Slippers"—http://www.toyvault.com/topfive/topfive.html, printed Dec. 21, 2011, product asserted to be available 2001.

*Primary Examiner* — Kien Nguyen

(74) *Attorney, Agent, or Firm* — Patent Law Offices Michael E. Woods; Michael E. Woods

(57) ABSTRACT

A system and method for increasing customer interest in articles of manufacture, including hand-held portable canopies, such as umbrellas and parasols. A set of actuating components are coupled to moveable elements of the article of manufacture, the moveable elements respond to operation of an user-controlled actuating mechanism.

15 Claims, 19 Drawing Sheets

Related U.S. Application Data application No. 13/772,316, filed on Feb. 20, 2013, now Pat. No. 8,505,116, which is a continuation-in-part of application No. 13/588,035, filed on Aug. 17, 2012, now Pat. No. 8,752,308, which is a continuation of application No. 13/333,462, filed on Dec. 21, 2011, now Pat. No. 8,266,828, said application No. 13/860,516 is a continuation-in-part of application No. 13/588,035, filed on Aug. 17, 2012, now Pat. No. 8,752,308, said application No. 14/304,875 is a continuation-in-part of application No. 13/588,035, filed on Aug. 17, 2012, now Pat. No. 8,752,308.

(60) Provisional application No. 61/528,100, filed on Aug. 26, 2011, provisional application No. 61/429,177, filed on Jan. 2, 2011.

(51) Int. Cl.

| | |
|---|---|
| ***A63H 3/00*** | (2006.01) |
| ***A63H 3/06*** | (2006.01) |
| ***A45B 25/00*** | (2006.01) |
| *F15B 15/10* | (2006.01) |
| *A45F 3/00* | (2006.01) |

(56) References Cited

U.S. PATENT DOCUMENTS

| | | | | |
|---|---|---|---|---|
| 2,438,014 | A | 3/1948 | Lukowitz | |
| 2,673,349 | A | 3/1954 | Key | |
| 2,721,420 | A | 10/1955 | Chatten | |
| 2,758,418 | A | 8/1956 | Troppe | |
| 2,803,015 | A | 8/1957 | Milone | |
| 2,827,066 | A * | 3/1958 | Nussbaumer | A45B 19/02 126/30 |
| 3,047,879 | A | 8/1962 | Spreiregen | |
| 3,125,827 | A | 3/1964 | Ostrander | |
| 3,141,261 | A | 7/1964 | Mirando | |
| 3,186,126 | A | 6/1965 | Ostrander | |
| 3,237,344 | A | 3/1966 | Ostrander | |
| 3,340,846 | A | 9/1967 | Magiera | |
| 3,451,160 | A | 6/1969 | Ryan et al. | |
| 3,501,144 | A | 3/1970 | Schmidt | |
| 3,738,024 | A | 6/1973 | Matsuda | |
| 3,740,893 | A | 6/1973 | Shinoda | |
| 3,882,631 | A | 5/1975 | Goldfarb et al. | |
| 4,009,528 | A | 3/1977 | Villari, Jr. et al. | |
| 4,057,928 | A | 11/1977 | Terzian | |
| 4,067,138 | A | 1/1978 | Cederholm et al. | |
| 4,124,952 | A | 11/1978 | Terzian | |
| 4,217,725 | A | 8/1980 | Sapkus et al. | |
| 4,218,780 | A | 8/1980 | Growe et al. | |
| 4,287,681 | A | 9/1981 | Albert et al. | |
| 4,324,005 | A | 4/1982 | Willis | |
| 4,370,994 | A | 2/1983 | Pittman | |
| 4,669,997 | A | 6/1987 | Kulesza et al. | |
| 4,759,737 | A | 7/1988 | Ferenczi | |
| 4,828,526 | A | 5/1989 | Schneider et al. | |
| 4,845,865 | A | 7/1989 | Chang et al. | |
| D328,179 | S | 7/1992 | Barker | |
| 5,129,106 | A | 7/1992 | Liou | |
| D336,543 | S | 6/1993 | Murray, III et al. | |
| 5,243,707 | A | 9/1993 | Bodinet | |
| 5,257,470 | A | 11/1993 | Auger et al. | |
| 5,259,070 | A | 11/1993 | De Roza | |
| 5,285,585 | A | 2/1994 | Baker | |
| 5,325,539 | A | 7/1994 | Kronenberger | |
| 5,353,525 | A | 10/1994 | Grim | |
| 5,391,106 | A | 2/1995 | Lidert, Jr. | |
| 5,564,201 | A | 10/1996 | O'Connell | |
| 5,725,004 | A * | 3/1998 | Moulder | B60J 5/0494 135/15.1 |
| D410,318 | S | 6/1999 | Chen | |
| 6,094,742 | A | 8/2000 | Gattamorta | |
| 6,354,314 | B1 | 3/2002 | Iurincich | |
| 6,389,604 | B1 | 5/2002 | Day | |
| 6,439,950 | B1 | 8/2002 | Goldman et al. | |
| 6,609,942 | B1 | 8/2003 | Cole et al. | |
| 6,672,932 | B1 | 1/2004 | Panec et al. | |
| 6,681,504 | B2 | 1/2004 | Kinan | |
| 6,881,119 | B2 | 4/2005 | Panec et al. | |
| 6,889,451 | B2 | 5/2005 | Passke et al. | |
| 6,913,030 | B1 | 7/2005 | Chmelik Martinec | |
| 7,451,555 | B1 | 11/2008 | Lakic | |
| 7,909,048 | B2 * | 3/2011 | Chmelik Martinec | A45B 19/02 135/20.2 |
| 8,105,129 | B2 | 1/2012 | Chen | |
| 8,266,828 | B2 | 9/2012 | Strong | |
| 8,327,462 | B2 | 12/2012 | Feldman et al. | |
| 8,505,116 | B2 | 8/2013 | Strong | |
| 2003/0084593 | A1 | 5/2003 | Lakic | |
| 2003/0135914 | A1 | 7/2003 | Racine et al. | |
| 2004/0003452 | A1 | 1/2004 | Schiebl | |
| 2004/0226078 | A1 | 11/2004 | Lahman et al. | |
| 2005/0223601 | A1 | 10/2005 | Dabah | |
| 2010/0219221 | A1 | 9/2010 | Zheng | |
| 2012/0167270 | A1 | 7/2012 | Strong | |
| 2013/0152985 | A1 | 6/2013 | Vaitl | |
| 2013/0160188 | A1 | 6/2013 | Strong | |
| 2014/0182639 | A1 | 7/2014 | Wise | |

FOREIGN PATENT DOCUMENTS

| | | | |
|---|---|---|---|
| KR | 20-1994-0021732 | | 10/1994 |
| KR | 20-2000-0002938 | | 2/2000 |
| KR | 1020040039214 | A | 5/2004 |
| KR | 20-0369494 | | 12/2004 |
| KR | 20-0437670 | | 12/2007 |
| KR | 2020100005134 | U | 5/2010 |
| KR | 2020110008364 | U | 8/2011 |
| WO | 2007025353 | A1 | 3/2007 |
| WO | 2012092152 | A2 | 7/2012 |

* cited by examiner

PORTABLE FOLDING CANOPY WITH MOVEABLE ELEMENT

CROSS REFERENCE TO RELATED APPLICATIONS

This application is a continuation-in-part of U.S. patent application Ser. No. 14/304,875 which is turn is a continuation-in-part of U.S. patent application Ser. No. 13/588,035 and a continuation-in-part of U.S. patent application Ser. No. 13/860,516 which is a continuation-in-part of U.S. patent application Ser. No. 13/588,035 and a continuation-in-part of U.S. patent application Ser. No. 13/772,316, both of which are a continuation of U.S. patent application Ser. No. 13/333,462, now U.S. Pat. No. 8,266,828, which claims benefit of both U.S. Provisional Application No. 61/429,177, filed 2 Jan. 2011, and U.S. Provisional Application No. 61/528,100, filed 26 Aug. 2011, the contents of these applications in their entireties are expressly incorporated by reference thereto for all purposes.

FIELD OF THE INVENTION

The present invention relates generally to portable canopies, and more specifically, but not exclusively, to user-portable canopies having user-controlled moveable elements.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

There are many types of user-portable canopies and portable coverings that are used to protect and shield a user from the environment (e.g., an umbrella for rain and other precipitation and a parasol for sun). Retailers continue to search for changes in user-portable canopies to increase customer interest.

What is needed is a system and method for increasing customer interest in canopies.

BRIEF SUMMARY OF THE INVENTION

Disclosed is a system and method for increasing customer interest in portable articles of manufacture, including user-portable canopies. The following summary of the invention is provided to facilitate an understanding of some of technical features related to active user-portable canopies with one or more moveable elements and the like, and is not intended to be a full description of all embodiments of the present invention. A full appreciation of the various aspects of the invention can be gained by taking the entire specification, claims, drawings, and abstract as a whole. The present invention is applicable to other styles of user-portable canopies besides umbrellas and parasols, non-portable user foldable canopies, and large semi-portable foldable canopies such as beach umbrellas or other outdoor folding canopies for covering large areas, and to other types and methodologies of actuating mechanisms, including machine-powered actuating mechanisms for larger implementations.

An active canopy, including a hand-held container portion including one or more walls defining a cavity accessible through an opening; a handle portion coupled to the one or more walls configured to support the container portion while being carried; and an actuator assembly, including: a first actuating mechanism coupled to the handle portion, the first actuating mechanism having a bulb defining a first actuating volume containing a first quantity of air, the bulb repeatably collapsible to expel a portion of the first quantity of air through a first actuating port of the bulb, the bulb automatically expanding to refill the first actuating volume; a first remote actuator having a pair of flexible layers forming a non-deformable actuating balloon defining a second actuating volume accessible through a second actuating port, the first remote actuator having a fixed portion foldably coupled to a moving portion at a fold region with the moving portion at least partially overlapping the fixed portion defining a folded configuration, the fixed portion coupled to the one or more walls of the container portion with the fold region and the moving portion both disposed outside of the cavity, the first remote actuator unfolding about the fold region from the folded configuration in response to air entering into the second actuating volume with the moving portion moving away from the fixed portion and the first remote actuator folding about the fold region in response to air exiting from the second actuating volume, the first remote actuator biased to the folded configuration; and an air communication channel coupled to the first actuating port of the first actuating mechanism and to the second actuating port of the first remote actuator.

An active container, including a container portion having a rigid inner shell defining a container cavity accessible through an opening, the rigid inner shell covered by an outside layer; and an actuator assembly, including: a first actuating mechanism having a collapsible structure defining a first actuating volume containing a first quantity of air, the collapsible structure repeatably collapsible to expel a portion of the first quantity of air through a first actuating port of the collapsible structure, the collapsible structure automatically expanding to refill the first actuating volume; a first remote actuator having a pair of flexible layers forming an actuating balloon defining a second actuating volume accessible through a second actuating port configured to repeatably inflate and deflate the actuating balloon, the first remote actuator having a first portion coupled to a second portion defining an unactuated configuration when the actuating balloon is deflated and defining an actuated configuration when the actuating balloon is inflated, the first portion fixed to the rigid shell with the second portion disposed outside of the container portion, the first remote actuator transitioning from the unactuated configuration to the actuated configuration in response to air entering into the second actuating volume and the first remote actuator transitioning from the actuated configuration to the unactuated configuration in response to air exiting from the second actuating volume, the first remote actuator biased to the unactuated configuration; and an air communication channel coupled to the first actuating port of the first actuating mechanism and to the second actuating port of the first remote actuator.

A method for operating an active container, including a) carrying a container portion using a handle portion coupled to the container portion, the container portion including one or more walls defining a cavity accessible through an opening; b) collapsing a collapsible structure coupled to the handle portion while carrying the container portion to expel a quantity of air from a first actuating volume of the collapsible structure through a first actuating port; c) communicating an increased air pressure, responsive to the quantity of air expelled from the first actuating volume, to a remote actuator coupled to the container portion, the remote actuator having a pair of flexible layers forming a non-deformable actuating balloon defining a second actuating volume accessible through a second actuating port, the remote actuator having a fixed portion foldably coupled to a moving portion at a fold region with the moving portion at least partially overlapping the fixed portion defining a folded configuration, the fixed portion fixed to the one or more walls with the fold region and the moving portion both disposed outside of the container portion, the remote actuator unfolding about the fold region from the folded configuration in response to air entering into the second actuating volume responsive to the increased air pressure with the moving portion moving away from the fixed portion and the first remote actuator folding about the fold region in response to air exiting from the second actuating volume, the remote actuator biased to the folded configuration; d) moving, responsive to the increased air pressure, a sheath to an operated configuration, the sheath coupled to an outside surface of the one or more walls wherein the sheath conceals the fold region and the moving portion of the remote actuator extending outside the container portion with the sheath coupled to the moving portion and having the operated configuration when the remote actuator is unfolded; and e) moving the sheath to an unoperated configuration irrespective of whether the collapsible structure is released by transitioning the remote actuator to the folded configuration by an exiting of air from the second actuating volume, the sheath having the unoperated configuration when the remote actuator is folded wherein the exiting of air includes an exit through a bleed mechanism communicated to the second actuating volume and may additionally include an exit of air by releasing the collapsible structure allowing the collapsible structure to automatically expand and refill the first actuating volume.

An air-actuated device, including an article of manufacture configured to be carried by a user, the article of manufacture having body defining a cavity, a collapsible support structure coupled to the body configured for supporting the body, and a sheath assembly coupled to the body, the sheath assembly including an exterior wall having a first outside portion and a second outside portion with the sheath assembly having an unactuated mode and an actuated mode, the unactuated mode providing the sheath assembly overlying the article of manufacture displaying the first outside portion while concealing the second outside portion and the actuated mode providing the sheath assembly extending from the article of manufacture and displaying the second outside portion; and a discrete air-powered actuator assembly coupled to the article of manufacture, the discrete air-powered actuator assembling including: a first discrete air bladder disposed within the collapsible support and having a first exterior wall containing a first bladder volume, the first exterior wall providing a first shape memory repeatedly inflating the first bladder volume after a collapse of the first bladder volume, the first bladder volume including a first capacity for a first quantity of air with the first discrete air bladder including an outlet exiting a portion of the first quantity of air from the first bladder volume when the first exterior wall is collapsed; a second discrete air bladder coupled to both the body and to the sheath assembly, the second discrete air bladder having a second exterior wall containing a second bladder volume, the second discrete air bladder remotely located relative to the first discrete air bladder, and the second bladder volume including a second capacity for a second quantity of air, the second discrete air bladder including an unactuated mode and an actuated mode, the unactuated mode providing the second discrete air bladder in an unactuated configuration having a proximal portion of the second discrete air bladder positioned relative to a distal portion of the second discrete air bladder, the unactuated configuration defining a separation between the portions equal to a first distance, and the actuated mode providing the second discrete air bladder in an actuated configuration having the separation greater than the first distance, wherein an actuating transition of the second discrete air bladder from the unactuated mode to the actuated mode transitions the sheath assembly from the unactuated mode to the actuated mode and wherein a biased transition of the second discrete air bladder from the actuated mode to the unactuated mode transitions the sheath assembly from the actuated mode to the unactuated mode; and an elongate communication channel, coupled to the outlet and to the second discrete air bladder; wherein the second discrete air bladder is biased to the unactuated mode; wherein the second discrete air bladder moves from the unactuated configuration to the actuated configuration responsive to air exiting from the first bladder volume; and wherein the second discrete air bladder collapses from the actuated configuration to the unactuated configuration when air exits the second bladder volume.

A method for operating an air-powered actuator system disposed within an article of manufacture, the method including (a) collapsing repeatedly a first air cavity defined in a bladder coupled to a collapsible support structure of the article of manufacture, each collapse expelling a portion of a first quantity of air contained within the first air cavity wherein the support structure is configured to carry a body of the article of manufacture; and (b) expanding repeatedly the first air cavity; and (c) initiating, responsive to each the collapsing step (a), a transfer of each portion of air towards a second air cavity included within an air-actuated active element coupled to the body of the article of manufacture, the active element having a distal portion and a proximal portion moveably coupled to the distal portion wherein the distal portion moves relative to the proximal portion when inflating and deflating, each the portion of air flowing in a flexible conduit connecting the first air cavity to the second air cavity with the portion of air flowing in the flexible conduit beginning a transition of the air-actuated active element from a biasedly-closed unactuated mode towards an open unactuated mode, the unactuated mode having the second air cavity substantially deflated and the second actuated mode having the second air cavity at least partially inflated and extended.

A plush toy, including a body having a first outside layer including a plush material and defining a body cavity; a sheath assembly coupled to the body; and a discrete air-powered actuator assembly coupled to the article of manufacture, the discrete air-powered actuator assembling including: a first discrete air bladder disposed within the body cavity and having a first exterior wall containing a first bladder volume, the first exterior wall providing a first shape memory repeatedly inflating the first bladder volume after a collapse of the first bladder volume, the first bladder volume including a first capacity for a first quantity of air with the first discrete air bladder including an outlet exiting a portion of the first quantity of air from the first bladder volume when the first exterior wall is collapsed; a second discrete air bladder coupled to both the body and to the sheath assembly, the second discrete air bladder having a second exterior wall containing a second bladder volume, the second discrete air bladder remotely located relative to the first discrete air bladder, and the second bladder volume including a second capacity for a second quantity of air, the second discrete air bladder including an unactuated mode and an actuated mode, the unactuated mode providing the second discrete air bladder in an unactuated configuration having a proximal portion of the second discrete air bladder positioned relative to a distal portion of the second discrete air bladder, the unactuated configuration defining a separation between the portions equal to a first distance, and the actuated mode providing the second discrete air bladder in an actuated configuration having the separation greater than the first distance, wherein an actuating transition of the second discrete air bladder from the unactuated mode to the actuated mode transitions the sheath assembly from the unactuated mode to the actuated mode and wherein a biased transition of the second discrete air bladder from the actuated mode to the unactuated mode transitions the sheath assembly from the actuated mode to the unactuated mode; and an elongate communication channel, coupled to the outlet and to the second discrete air bladder; wherein the second discrete air bladder is biased to the unactuated mode; wherein the second discrete air bladder moves from the unactuated configuration to the actuated configuration responsive to air exiting from the first bladder volume; and wherein the second discrete air bladder collapses from the actuated configuration to the unactuated configuration when air exits the second bladder volume.

An air-actuated device, including a canopy article of manufacture configured to be carried by a user, the canopy article of manufacture having a shaft supporting a collapsible frame and a canopy cover coupled to the collapsible frame, the canopy cover including a sheath assembly coupled to an exterior wall of the canopy cover, the sheath assembly having a first outside portion and a second outside portion with the sheath assembly having an unactuated mode and an actuated mode, the unactuated mode providing the sheath assembly overlying the exterior wall displaying the first outside portion while concealing the second outside portion and the actuated mode providing the sheath assembly extending from the canopy article of manufacture and displaying the second outside portion; and a discrete air-powered actuator assembly coupled to the canopy article of manufacture, the discrete air-powered actuator assembling including: a first discrete air bladder coupled to the shaft and having a first exterior wall containing a first bladder volume, the first exterior wall providing a first shape memory repeatedly inflating the first bladder volume after a collapse of the first bladder volume, the first bladder volume including a first capacity for a first quantity of air with the first discrete air bladder including an outlet exiting a portion of the first quantity of air from the first bladder volume when the first exterior wall is collapsed; a second discrete air bladder coupled to both the canopy cover and to the sheath assembly, the second discrete air bladder having a second exterior wall containing a second bladder volume, the second discrete air bladder remotely located relative to the first discrete air bladder, and the second bladder volume including a second capacity for a second quantity of air, the second discrete air bladder including an unactuated mode and an actuated mode, the unactuated mode providing the second discrete air bladder in an unactuated configuration having a proximal portion of the second discrete air bladder positioned relative to a distal portion of the second discrete air bladder, the unactuated configuration defining a separation between the portions equal to a first distance, and the actuated mode providing the second discrete air bladder in an actuated configuration having the separation greater than the first distance, wherein an actuating transition of the second discrete air bladder from the unactuated mode to the actuated mode transitions the sheath assembly from the unactuated mode to the actuated mode and wherein a biased transition of the second discrete air bladder from the actuated mode to the unactuated mode transitions the sheath assembly from the actuated mode to the unactuated mode; and an elongate communication channel, coupled to the outlet and to the second discrete air bladder; wherein the second discrete air bladder is biased to the unactuated mode; wherein the second discrete air bladder moves from the unactuated configuration to the actuated configuration responsive to air exiting from the first bladder volume; and wherein the second discrete air bladder collapses from the actuated configuration to the unactuated configuration when air exits the second bladder volume.

A method for operating an air-powered actuator system disposed within a canopy article of manufacture, the method including (a) collapsing repeatedly a first air cavity defined in a bladder coupled to a central shaft of the canopy article of manufacture, the central shaft supporting a collapsible moveable frame and a canopy cover coupled to the collapsible moveable frame, each collapse expelling a portion of a first quantity of air contained within the first air cavity; and (b) expanding repeatedly the first air cavity; and (c) initiating, responsive to each the collapsing step (a), a transfer of each portion of air towards a second air cavity included within an air-actuated active element coupled to the canopy cover, the active element having a distal portion and a proximal portion moveably coupled to the distal portion wherein the distal portion moves relative to the proximal portion when inflating and deflating, each the portion of air flowing in a flexible conduit connecting the first air cavity to the second air cavity with the portion of air flowing in the flexible conduit beginning a transition of the air-actuated active element from a biasedly-closed unactuated mode towards an open unactuated mode, the unactuated mode having the second air cavity substantially deflated and the second actuated mode having the second air cavity at least partially inflated and extended.

A collapsible canopy, including a central shaft supporting a collapsible moveable folding frame, the frame configured to move along the central shaft between an open mode and a closed mode; a canopy cover coupled to the folding frame; an actuator coupled through the canopy cover, the actuator having an actuator exterior wall defining an internal actuator cavity accessed through an actuator opening wherein the actuator exterior wall is self-biased to an unactuated mode with the actuator configured to respond to an air pressure differential at the actuator opening to transition to an actuated mode; a collapsible bladder having a bladder exterior wall defining an internal bladder cavity accessed through a bladder opening wherein the bladder exterior wall includes a collapsible construction producing an output air quantity at the bladder opening when the bladder exterior wall is collapsed; and an elongate communication channel coupled to the bladder opening and to the actuator opening, the elongate communication channel communicating the air pressure differential to the actuator responsive to the output air quantity.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIG. 4 illustrates the valve allowing air into an air reservoir;

FIG. 5 illustrates the valve with the bleed mechanism bleeding air from the air reservoir;

FIG. 15-FIG. 16 illustrate a puppy thematic embodiment of a hand-held canopy having moveable ears;

FIG. 15 illustrates the hand-held canopy in an unactuated mode;

FIG. 16 illustrates the hand-held canopy in the actuated mode;

FIG. 17-FIG. 18 illustrate a fish thematic embodiment of a hand-held canopy having moveable fins;

FIG. 17 illustrates the hand-held canopy in an unactuated mode;

FIG. 18 illustrates the hand-held canopy in the actuated mode;

FIG. 19-FIG. 20 illustrate an owl thematic embodiment of a hand-held canopy having moveable wings;

FIG. 19 illustrates the hand-held canopy in an unactuated mode;

FIG. 20 illustrates the hand-held canopy in the actuated mode;

FIG. 21-FIG. 22 illustrate a fox thematic embodiment of a hand-held canopy having moveable ears and tail;

FIG. 21 illustrates the hand-held canopy in an unactuated mode;

FIG. 22 illustrates the hand-held canopy in the actuated mode;

FIG. 23 illustrates an internal cross-section of a hand-held canopy; and

FIG. 24 illustrates a sealing detail for an umbrella implementation of a hand-held canopy.

DETAILED DESCRIPTION OF THE INVENTION

Figure 1:
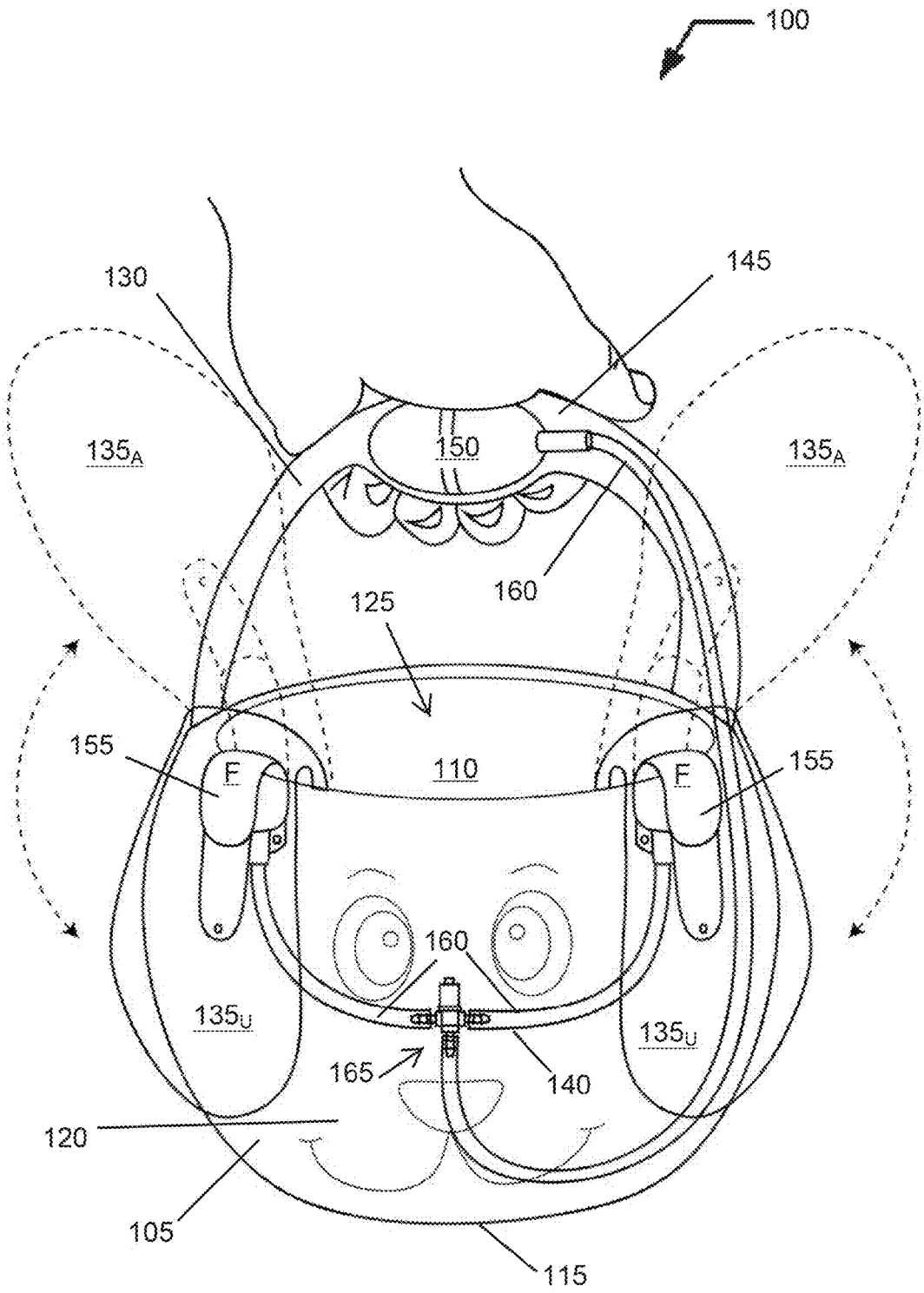
FIG. 1 illustrates a front isometric view of an active container having one or more moveable elements arranged into a thematic configuration.

Embodiments of the present invention provide a system and method for increasing customer interest in user-portable canopies. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

U.S. Pat. No. 8,266,828 for Footwear Having Air-controlled Active Elements describes a clothing article for a foot in which active elements associated with the clothing article were automatically activated as the user walked. This patent is hereby expressly incorporated by reference thereto in its entirety for all purposes.

In the following discussion and in the figures, a modification to various styles of user-portable canopies is shown, however it is understood that the present invention may be adapted to other styles of containers. A Halloween basket is a thematic user-portable canopy for children and young adults for use during Halloween activities, though the user-portable canopies of the present invention are not limited to such uses. The Halloween basket includes a container portion having a container cavity for storing objects and a handle portion secured to the container portion. One or more of these portions may include static animal, fanciful creature, or "monster" features and a thematic likeness of the depicted animal, creature, or monster. Sometimes there is a lid or covering, and moveable elements added to provide a representation of a limb, or other body part of the depicted animal, creature, or monster. Embodiments of the present invention include structures and methods that animate one or more features of such a user-portable canopy under a user's control.

A lunch box is a thematic user-portable canopy for children and young adults for use to store and/or convey foodstuff, though the user-portable canopies of the present invention are not limited to such uses. The lunch box includes a container portion having a container cavity for storing foodstuff and smaller foodstuff containers and a handle portion secured to the container portion. One or more of these portions may include static animal, fanciful creature, or "monster" features and a thematic likeness of the depicted animal, creature, or monster. Sometimes there is a lid or covering, and moveable elements added to provide a representation of a limb, or other body part of the depicted animal, creature, or monster. Embodiments of the present invention include structures and methods that animate one or more features of such a user-portable canopy under a user's control.

A backpack is a thematic user-portable canopy for children and young adults for use to store, organize, and/or convey other smaller articles, though the user-portable canopies of the present invention are not limited to such uses. The backpack includes a container portion having a container cavity for storing the articles, a pair of should straps secured to the container portion, and optionally a handle portion secured to the container portion. One or more of these portions may include static animal, fanciful creature, or "monster" features and a thematic likeness of the depicted animal, creature, or monster. Sometimes there is a lid or covering, and moveable elements added to provide a representation of a limb, or other body part of the depicted animal, creature, or monster. Embodiments of the present invention include structures and methods that animate one or more features of such a user-portable canopy under a user's control.

A plush toy is a thematic article of manufacture for children and young adults for entertainment often referred to as a "stuffed animal," though embodiments of the present invention are not limited to such specific implementations of a plush toy. The plush toy includes a body portion having a cavity, a set of extensions secured to the body portion, and optionally a handle portion secured to the body portion. One or more of these portions may include static animal, fanciful creature, or "monster" features and a thematic likeness of the depicted animal, creature, or monster. Sometimes there is a lid or covering, and moveable elements added to provide a representation of a limb, or other body part of the depicted animal, creature, or monster. Embodiments of the present invention include structures and methods that animate one or more features of such a user-portable canopy under a user's control.

Definitions:

Unless otherwise defined, all terms (including technical and scientific terms) used herein have the same meaning as commonly understood by one of ordinary skill in the art to which this general inventive concept belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The following definitions apply to some of the aspects described with respect to some embodiments of the invention. These definitions may likewise be expanded upon herein.

As used herein, the term "or" includes "and/or" and the term "and/or" includes any and all combinations of one or more of the associated listed items. Expressions such as "at least one of," when preceding a list of elements, modify the entire list of elements and do not modify the individual elements of the list.

As used herein, the singular terms "a," "an," and "the" include plural referents unless the context clearly dictates otherwise. Thus, for example, reference to an object can include multiple objects unless the context clearly dictates otherwise.

Also, as used in the description herein and throughout the claims that follow, the meaning of "in" includes "in" and "on" unless the context clearly dictates otherwise. It will be understood that when an element is referred to as being "on" another element, it can be directly on the other element or intervening elements may be present therebetween. In contrast, when an element is referred to as being "directly on" another element, there are no intervening elements present.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "connect," "connected," and "connecting" refer to a direct attachment or link. Connected objects have no or no substantial intermediary object or set of objects, as the context indicates.

As used herein, the terms "couple," "coupled," and "coupling" refer to an operational connection or linking. Coupled objects can be directly connected to one another or can be indirectly connected to one another, such as via an intermediary set of objects.

As used herein, the terms "substantially" and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

As used herein, the terms "optional" and "optionally" mean that the subsequently described event or circumstance may or may not occur and that the description includes instances where the event or circumstance occurs and instances in which it does not.

FIG. 1 illustrates a front isometric view of an active container 100 having one or more moveable elements arranged into a thematic configuration, in this case, a puppy. Active container 100 includes a container portion 105 that is designed to define a holding volume 110 defined by a bottom wall 115 and one or more sidewalls 120. An opening 125, often disposed at a top of container portion 105 allows access into holding volume 110. Active container 100 includes a handle portion 130 coupled to opposing portions of the top of container portion 105. Active container 100 includes one or more moveable elements 135, for example puppy ears, that are responsive to operation of an actuator assembly 140.

Container portion 105 may be of unitary construction or may include an assembly of flexible, semi-rigid/flexible, and/or rigid components. For example, in some implementations a rigid shell may be formed and an exterior covering or overwrap applied to conceal the shell. In other implementations, an inner layer and an outer layer may be combined. In both cases there are one or more spaces between an innermost component and an outermost component that is available to conceal actuator assembly 140.

Container portion 105 is preferably constructed having at least two layers, an inside shell and an outside layer. The material may be natural or synthetic fabric, leather, polymer, elastomer, or the like, of virtually any type with the disclosed embodiments including one or more outer/visible components being of plush construction. Plush, in this context refers to natural (e.g., mohair, worsted yarn, silk) or synthetic (e.g., polyester) fibers and may include a filler or "stuffing"

between the inside shell and the outside layer. In some implementations, the outer layer does not completely cover the inside shell of container portion 105 leaving some part(s) uncovered. Other implementations may dispense with the outside layer completely. Such implementations may not conceal some or all of the actuating components, or the actuating components may be integrated or concealed in some other fashion, such as integrating air channels inside the inner shell.

As described herein, active container 100 includes one or more user-controlled moveable elements 135. There is a wide range of different configurations, sizes, and weights associated with moveable elements 135. Moveable elements 135 are manually controlled by operation of actuator assembly 140. Components of actuator assembly 140 are distributed. Actuator assembly 140 includes an actuating mechanism, one or more remote actuators, a conduit communicating air from the actuating mechanism to the one or more actuators, and an intake valve assembly disposed within the conduit. Some implementations may include multiple actuating mechanisms, each controlling the same actuators or a different set of actuators.

Handle portion 130 of the disclosed embodiments include a multilayer construction to form an inner channel and may be constructed of the same material as used in the outer layer of container portion 105. In the preferred embodiments a thematic configuration is often set for active container 100, such as a particular animal, fanciful creature, monster, or the like. Moveable elements 135 are configured to further support and extend the theme, such as by providing moving limbs and the like. Handle portion 130 may also extend the theme by also providing theme-specific visualizations and arrangements. A middle part 145 of handle portion 130 includes a larger space or gap.

In the disclosed embodiments, middle part 145 has a greater lateral width than handle portion 130 because it hides an actuating mechanism used to manipulate the one or more moveable elements 135. The disclosed embodiments include one or more moveable elements and one or more actuating mechanisms hidden in handle portion 130. Some implementations provide that two moveable elements may be independently controlled by two actuating mechanisms while other implementations include the two moveable elements controlled concurrently by the same single actuating mechanism. This principle may be extended to more than two moveable elements with a first set controlled by a first actuating mechanism and a second set controlled by a second actuating mechanism. The disclosed embodiments provide for a maximum of two actuating mechanisms in middle part 145, one directed toward each lateral side of container portion 105.

Handle portion 130 is not limited to a rigid or semi-rigid "arch" over a top opening of container portion 105. The opening in container portion 105 may include openings other than a top opening, including a side or oblique (partially top and partially side) opening and handle portion 130 may have virtually any relationship to the opening and/or container portion 105. For example, handle portion 130 may extend from a side like a coffee mug and include a concealed or integrated actuating mechanism. Handle portion 130 may include or consist of soft flexible strap portions. Handle portion 130 may support, conceal, or form all or a portion of the actuating mechanism and/or a portion of the conduit. Handle portion 130 may include a structure defining a hollow tube or channel further defining a suitably flexible region to allow actuation of the actuating mechanism(s), whether a single layer or multilayer construction or assembly.

Moveable elements 135 are external thematic elements that respond to the actuating mechanisms to tilt, lift, unfold, expand, extend, rotate, flap, open, or otherwise move to a first configuration when one or more actuating mechanisms are operated. Moveable elements 135 are biased to an untilted, dropped, folded, contracted, withdrawn, unrotated, closed, or otherwise motionless second configuration. Manual operation of actuating mechanism in handle portion 130 overcomes the bias to transition an effected moveable element from the second configuration to the first configuration. As further explained herein, moveable element 135, being biased to the second configuration, automatically transitions from the first configuration to the second configuration after a period.

Moveable elements 135 contain concealed actuators that are covered by material (e.g., cloth, plush, other fabric, plastic, rubber, and the like) that may be opaque, translucent, transparent or a combination of these properties. Some moveable elements 135 include a first portion that is visible in both the first configuration and in the second configuration and a second portion only visible in the first configuration. For example, in FIG. 1, active container 100 includes a puppy theme and moveable elements 135 are shown in the second configuration as unactuated puppy ears $\mathbf{135}_U$. When actuated, moveable elements 135 are lifted to the first configuration including an actuated set of puppy ears $\mathbf{135}_A$. Actuated set of puppy ears include an outside ear portion as the first portion and an inside ear portion as the second portion. As shown, in the first configuration, the outside ear portion is visible in both the first configuration and in the second configuration. The inside ear portion is visible in the first configuration only.

Moveable elements 135 of FIG. 1 are configured to lift laterally, but are not required to do so. A relative motion between moveable element 135 and container portion 105 is determined by the type of internal actuator included within moveable element 135 and the arrangement and specifics of an attachment configuration of moveable element to container portion 105, including any hinging coupling that physically connects moveable element 135 to container portion 105. Some moveable elements 135 may move laterally, frontally, rearwardly, side-to-side, bottom-to-top, diagonally, or a combination thereof. In some instances, the concealed actuator within moveable element 135 may have a complex motion.

FIG. 1 also illustrates a schematic view of actuator assembly 140. Actuator assembly 140 is typically concealed within the multilayers of active container 100. To facilitate visualization of the components of active container 100, actuator assembly 140 is illustrated in solid lines though they are, in the embodiment of FIG. 1, hidden from external view. This arrangement is only representative as there are many different component organizations that are possible to achieve the purpose and effect demonstrated by the depicted arrangement. The arrangement illustrated in FIG. 1 provides a type of single actuating mechanism controlling concurrently multiple moveable elements 135.

Actuator assembly 140 includes an actuating mechanism 150, one or more remote actuators 155, a conduit 160 communicating air from actuating mechanism 150 to the one or more remote actuators 155, and an intake valve assembly 165 disposed in conduit 160. In the disclosed embodiment, actuator assembly 140 may be formed as a discrete separate assembly that may be installed (e.g., cut and sewn) into active container 100. In other implementations, actuator assembly 140 may be independent elements separately installed and assembled into active container 100.

Some of the incorporated patent applications include a discussion of actuating components used in footwear. Actuator assembly 140 is adapted from those components to meet the special needs and requirements of the present invention. When adapting the footwear actuating components in the headwear context, there is no easy way to implement automatic actuation as was done in the footwear example which had the actuating mechanism disposed within the sole. Each step could result in automatic operation of the actuating mechanism which triggered moveable elements affixed to an upper of the footwear. Being disposed within a sole of child's shoe or the like imposed a number of design constraints including a relatively low capacity actuating mechanism and concerns regarding overpressure. The low capacity actuating mechanism required efficient small sized remote actuators and the potential overpressure results in sturdier construction and structures referred to as bleed valves. In the disclosed embodiments, the system is configured for some robustness as it allows for unintended perforations or injury to the air channels and actuating volumes to function as secondary bleed mechanisms. Thus the illustrated systems are considered open, lossy, and the like as opposed to sealed/closed systems.

Similar design constraints include efficient manufacturability and low cost of goods. Simple and non-complex is preferred over complicated and complex structures, assemblies, and arrangements. The disclosed embodiments detail a specific combination of actuating components that provides efficient repeatable motion to the moveable elements at a cost that results in a price point supported by the market for active containers.

Actuating mechanism 150 is similar in construction and operation to the corresponding structure in the incorporated applications. That is, actuating mechanism 150 includes a resilient bulb or bellows that contains an actuating air volume. The bulb is repeatably collapsible to expel a portion of the actuating air volume through an actuating port with each actuation. The bulb is configured to be collapsed by the user squeezing the bulb with a hand. Releasing the bulb allows the bulb to automatically expand and refill the actuating air volume with air. The air is refilled with ambient air, such as through a one-way valve disposed within the bulb and/or through intake valve assembly 165. When implemented for children, the bulb is made very pliable to be easily squeezed and operated by a young child.

One risk associated with the footwear implementation that is reduced in the embodiments described herein is that of rupture. An active footwear article that is operated by a bellows disposed in the sole is subject to potentially large impulses that can create significant overpressure stresses on the actuating assembly. These impulses may be easily produced, such as by jumping and landing on the soles of the footwear. Actuator assembly 140 is not as much at risk because it is more challenging for a user to generate similar impulses by squeezing the bulb.

Preferably the bulb is made from a blown plastic configured to contain a sufficient quantity of air to operate remote actuators 155, while being sufficiently pliable and robust to be repeatably squeezed and released without degradation of actuating mechanism's ability to expel the portion of air each time it is squeezed and refill when released.

Remote actuator 155 may be implemented in many different ways. The incorporated patent applications detail several different styles and types of remote actuators, any of which may be adapted for remote actuator 155. The disclosed embodiments include remote actuator 155 that includes an elongate resilient outer shell that contains an actuating volume accessed through an actuating port. Remote actuator 155 is controlled (e.g., unfolding and folding) by air entering into and leaving the actuating volume. An alternative includes a rolling/curling/furling implementation in which moves by air entering into and leaving the actuating volume (or air pressure changes responsive to the repetitive collapse and expansion of the bulb or some configuration).

Remote actuator 155 includes a folded configuration in which one portion overlies another portion when the actuating volume has little if any air, the amount of folding is greatest with the least amount of air within the actuating volume. Air entering into the actuating volume causes remote actuator 155 to unfold and straighten. A quantity of air entering into the actuating volume controls the degree and extent of the unfolding. Remote actuator 155 is unfolded to the greatest degree when the actuating volume contains the greatest quantity of air. In some implementations, remote actuator 155 may be fully unfolded when fully actuated. The actuating air volume of actuating mechanism 150 is sized to achieve the desired degree of unfolding of remote actuator 155, it being understood that some embodiments do not desire or require that remote actuator 155 fully unfold.

Remote actuator 155 is biased towards the fully folded configuration. Air entering into the actuating volume is calibrated to cause remote actuator 155 to unfold against the biasing force. Periodically the air pressure at the actuating port will drop below that which is sufficient to overcome the biasing force and remote actuator will then automatically fold and dispel all or a portion of air from the actuating volume to enable it to fold. The degree of folding is at least partially influenced by the air pressure at the actuating port resisting the dispelling of the air from the actuating volume.

In some embodiments, as noted above and as described in the incorporated patent applications, it may be desirable or required to include an optional bleed valve or the like in the actuating volume. For example, the bleed valve may be included at an extreme distal end when the proximal end includes the actuating port and a fold region F is intermediate the two ends. In this configuration, air entering into the actuating volume first unfolds remote actuator and as long as a rate of air entering into the actuating volume is greater than a rate of air exiting the bleed valve, remote actuator will continue to unfold. When air stops entering into the actuating volume, the air exiting the bleed valve will then allow remote actuator to automatically fold in response to the biasing forces.

Figure 2:
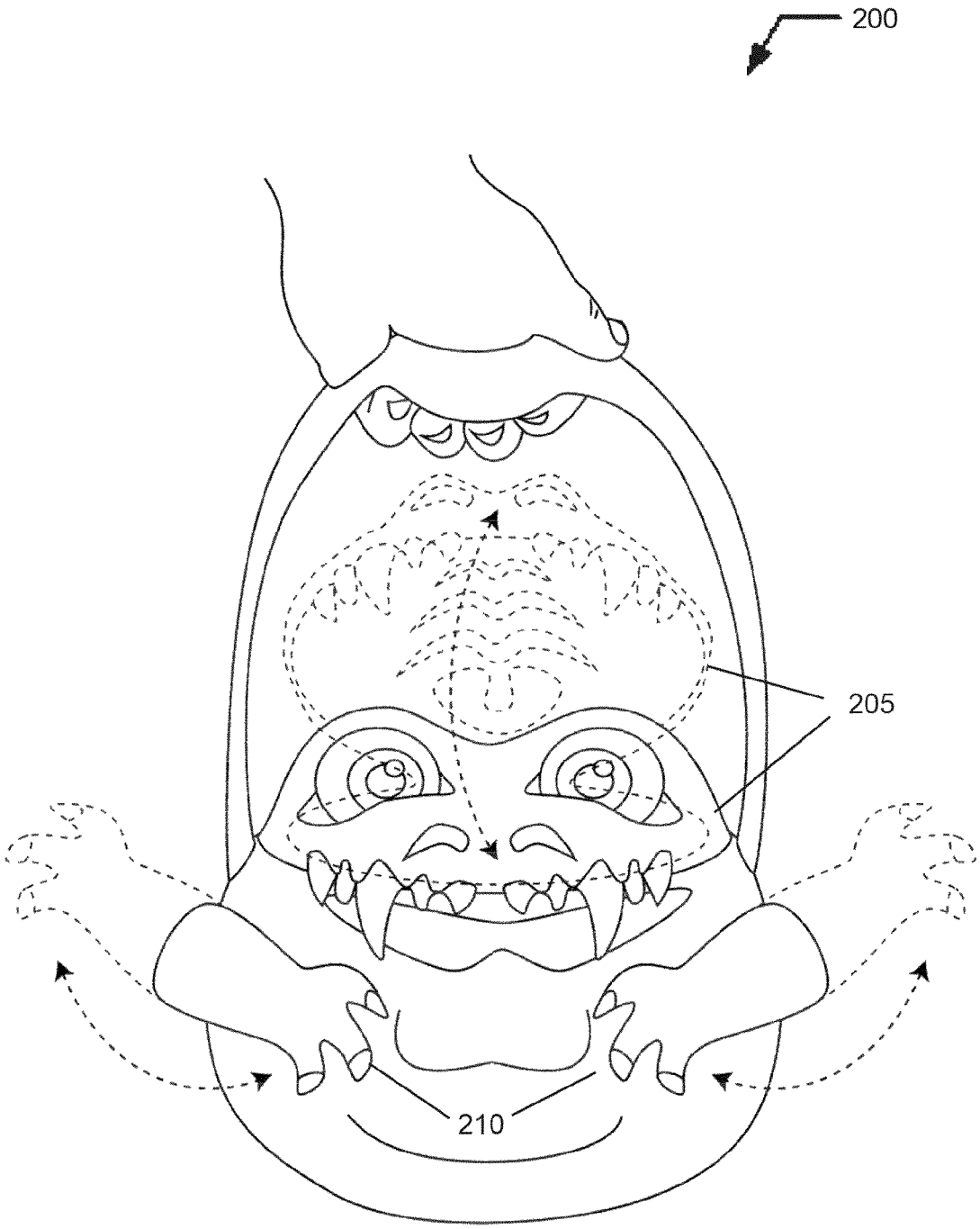
FIG. 2; illustrates a front isometric view of an alternate active container having one or more moveable elements arranged into a thematic configuration.

As noted in the incorporated patent applications, there are several different ways of providing the biasing force to remote actuator 155. A biasing mechanism provides the biasing force and may include a memory plastic that "memorizes" a desired folded shape, a metal spring with a restorative spring constant, a memory alloy with a preconfigured shape, or the like is preformed into a biasing configuration to position remote actuator into the folded configuration and attached to or integrated with remote actuator 155. Unfolding remote actuator 155 operates against the biasing mechanism which will begin to automatically fold remote actuator 155 once the air pressure within the actuating volume drops low enough. As illustrated in the embodiments of FIG. 1-FIG. 2, the biasing force may be supplemented by gravity to help fold/close the remote actuators.

An outer shell of remote actuator 155 is formed from a memory plastic that may be set (e.g., thermoset) into a biasing configuration. For example, remote actuator 155 includes a blow-molded shell of "memory" plastic having the internal cavity. The shell is initially formed into the unfolded configuration and then the shell is folded/bent into the folded configuration and then set so that the folded configuration is memorized. Thereafter, air entering into the folded shell will unfold it. Once the air pressure falls, the biasing forces from the outer shell will re-fold the actuator and will be ready for re-actuation. The cycle of unfolding and folding is repeatable. One advantage of this construction is that the outer shell forming the actuating volume may be made thin and pliable while a portion forming the actuating port may be more rigid and suitable for forming a conduit connector integrated into the manufacturing process and reducing costs of assembly.

In the footwear, in some embodiments it was important for responsiveness that a remote actuator automatically deflate after a period even when a user did not unweight the sole in preparation for another air-expelling weighting of the sole. In the present invention, because the remote actuators are manually operated, it is an implementation option to reproduce this behavior (e.g., to deactuate remote actuators 155 while actuating mechanism 150 remains actuated) or to maintain remote actuator 155 in the actuated configuration as long as the actuating mechanism remains actuated).

Conduit 160 includes air tubes and the like that are able to communicate air from actuating mechanism 150 to one or more remote actuators 155. In the disclosed embodiments, conduit 160 is non-expandable at the air pressures employed to actuate remote actuators 155. Thus in this context, conduit 160 is non-expandable. In the illustrated embodiments, conduit 160 includes an actuating mechanism end and one or more remote actuator ends. The actuating mechanism end is coupled to actuating mechanism 150 and the remote actuator ends are coupled to the actuating ports of remote actuator 155.

There are several different arrangements included in the illustrated embodiments. Illustrated in FIG. 1 is an arrangement in which a single actuating mechanism 150 operates a pair of remote actuators 155. One way this is accomplished is by use of intake valve assembly 165 also serving as a conduit multiplier (e.g., a "three-way" connector) that splits a single channel of conduit 160 into two or more channels. Other arrangements include a pair of actuating mechanisms operating either one or a pair of remote actuators. And as noted, the present invention includes implementations having more than two actuating mechanisms and/or more than two remote actuators.

For a pair of actuating mechanisms and pair of remote actuators, it is possible that the remote actuators are controlled independently from each other or controlled concurrently with each other. In an independent implementation, two conduits 160 are used, one conduit 160 extending from one actuating mechanism to the remote actuator it controls. In operation, one actuating mechanism controls one remote actuator and the other actuating mechanism controls the other remote actuator. In a concurrent implementation, a four-way conduit multiplier is used to co-join the two channels from the actuating mechanisms to the two channels from the remote actuators. In operation, either actuating mechanism actuates both remote actuators at the same time; an ambidextrous arrangement.

Intake valve assembly 165 is disclosed in the parent applications as a special three-way connector. It is special in that two-way airflow is unobstructed between a first port and a second port while airflow is one-way from a third port to the first port and the second port. In other words, when coupling the third port of intake valve assembly 165 to ambient, air may flow from ambient to the first port and/or the second port but air will not flow out to ambient from the third port. The first port and the second port are coupled to conduit 160 so that two-way air flow exists in the channel from an actuating mechanism to the one or more remote actuators.

In FIG. 1, intake valve assembly 165 is shown located remotely from actuating mechanism 150. The actuating port of actuating mechanism 150 is coupled to the first port of intake valve assembly 165 by conduit 160 and the second port of intake valve assembly 165 is coupled to another portion of conduit 160. The preferred embodiments also use a softer material in the construction of remote actuators because they may be made to be more easily actuated for operation by children.

In FIG. 1, remote actuators 155 are configured so that an outside portion is disposed outside the outer layer of container portion 105 and an inside portion is disposed between the multilayers of container portion 105. An aperture is made in the outer layer of container portion 105 and the distal end of remote actuator 155 is passed through. Fold portion is located at the aperture but slightly outside the outer layer of container portion 105. A sheath is made for remote actuator 155 and attached to container portion 105 at the aperture to completely hide remote actuator 155. As discussed herein, the sheath includes two portions, a first portion and a second portion, in the sense of visibility based upon a state of remote actuator. The sheath is preferably designed so that the first portion and the second portion are differently designed, providing some contrast, and attendant surprise and increased interest, when the second portion is selectively revealed upon actuation. These portions of the sheath correspond in some implementations to the outside ear portion and the inside ear portion.

When operating an actuating mechanism 150, air dispelled from the actuating air volume through the actuating port increases an air pressure of air within conduit 160 and increases the air pressure at the actuating ports of the remote actuators 155 that are coupled to the operated actuating mechanism 150. When the air pressure at the actuating port of the remote actuator(s) 155 is great enough to overcome the biasing force, air enters into the actuating volume and unfolds it against the biasing force. To an observer of the puppy themed active container 100, squeezing middle part 145 corresponding to the operated actuating mechanism 150, both of the puppy ears lift and reveal the inside ear portions. When the user stops squeezing the middle part 145, actuating mechanism 150 is released and the bulb is refilled with air from ambient, conduit 160, and from the actuating volume of remote actuator 155 corresponding to the actuated puppy ears. Consequently the puppy ears fall until only the outside ear portions are visible. For a dual arrangement of actuating mechanisms, it would be possible to independently control the ears such that squeezing a left-hand side portion raises a left-hand side puppy ear only and squeezing a right-hand side portion raises a right-hand side puppy ear only.

Of importance is anchoring in the attachment points where conduit 160 engages the actuating ports of remote actuators 155. Without proper definition of these anchors, remote actuators 155 may shift or bind within the sheath/outside layer portion and interfere with unfolding and folding. It is preferred that the fold region F be located outside the outer layer of container portion 105 to reduce any binding/unfolding limitation.

Further, the attachment of a proximal end remote actuator 155 (e.g., the end of remote actuator with the actuating port) inside of the outside layer helps define the relative motion of remote actuator 155 and container portion 105. Without proper anchoring and without proper orientation, a remote actuator that is intended to move moveable elements in a first direction (up/down laterally) may fail to move them or may move them up/down towards the front of the container which may not match the intended theme and thus be unacceptable to the wearer. In the case of an implementation including a rigid inner shell, is it beneficial to mount an inside portion of remote actuator 155 to the shell to resist shifting and errors in actuation.

FIG. 2; illustrates a front isometric view of an alternate active container 200 having one or more moveable elements arranged into a thematic configuration, in this case, a "monster." Except as noted herein, the arrangement and operation of alternate active container 200 corresponds to the arrangement and operation of active container 100.

Alternate active container 200 includes a lid 205 configured to conceal and cover holding volume 110. Lid 205 participates in the thematic configuration by appearing as a first moveable element arranged as a head/jaw of the monster. Instead of puppy ears, alternate active container 200 may include arms and claws as second moveable elements 210 that extend and fold. Lid 205 and second moveable elements 210 are operated by the actuator assembly disposed therein. When the user operates the actuator assembly, responsive to a set of remote actuators, lid 205 hingedly coupled to a rear wall/portion of the container portion lifts and opens to reveal holding volume 110 and second moveable elements 210 unfold and extend.

Figure 3:
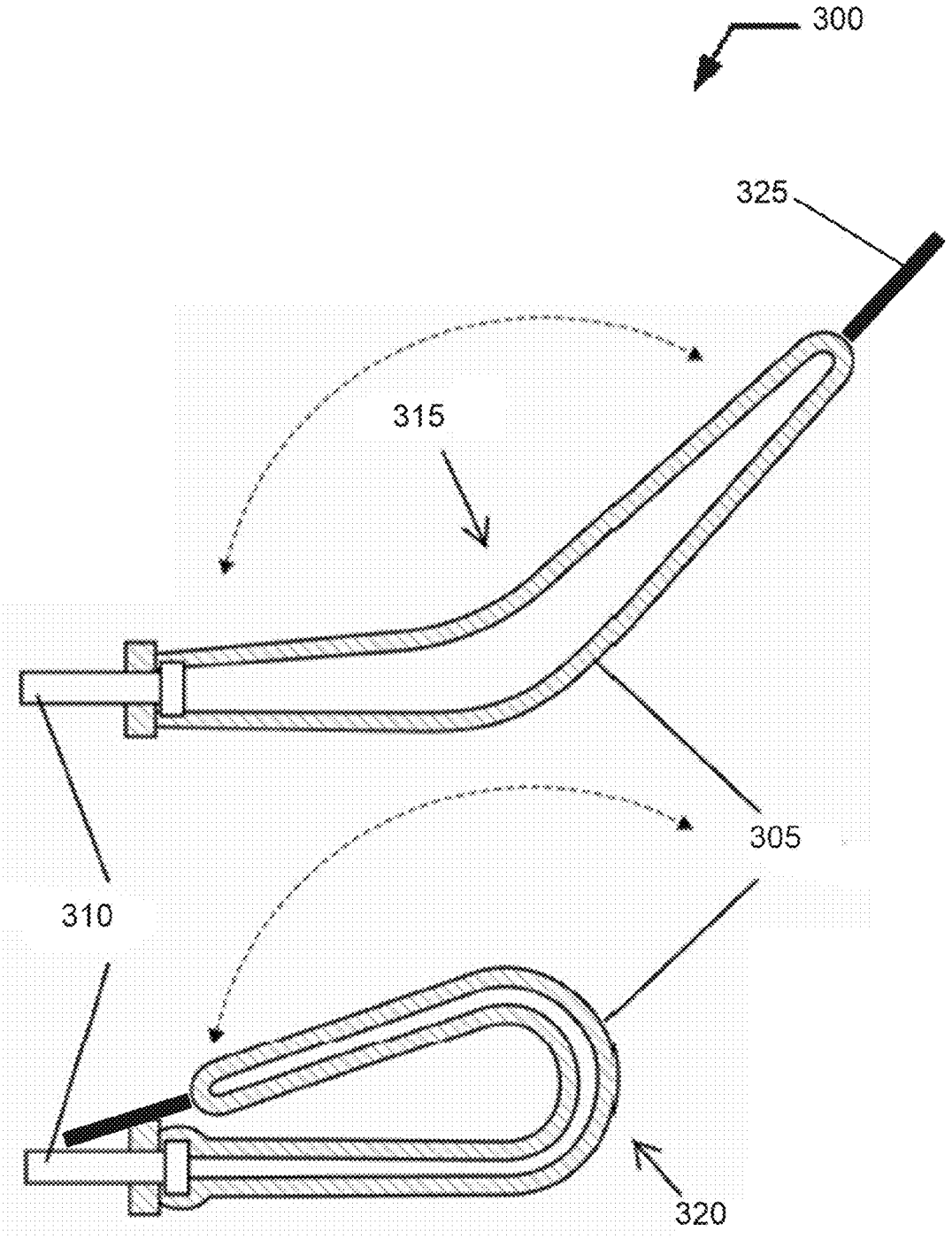
FIG. 3 illustrates a series of side elevation views of an operational sequence for a remote actuator for use with a themed fanciful air-powered active container described herein.

FIG. 3 illustrates a series of side elevation views of an operational sequence for a remote actuator 300 for use with a themed fanciful air-powered active container described herein. Remote actuator 300 may simulate one of a moveable element 135 (e.g., an expanding/contracting limb, appendage, growth, or door, hatch, portal, or the like). Remote actuator 300 includes a folding/unfolding balloon 305 that is soft and mounted to an actuating port 310. Remote actuator 300 opens (e.g., unfolds) when inflated to provide an extended structure 315 and closes (e.g., folds) when deflated to provide a retracted structure 320. Remote actuator 300 includes an optional extension member 325 that is non-inflating hard/rigid portion of balloon 305. In some implementations, dimensions of an active portion of balloon 305 may be relatively short. In order to move longer moveable elements, extension member 325 is used to leverage movement of balloon 305 to better support moveable elements that are longer than the active portion. Extension member 325 includes mounting holes to allow attachment of the sheath of moveable elements 135. In the preferred embodiment, extension member 325 is periodically scored along its length to enable its length to be easily shortened in reproducible predetermined lengths to best match needed lengths.

In some implementations, remote actuator 300 is manufactured of thermoplastic rubber (TPR), blown plastic, and other polymers that may have "memory" properties to be biased into the folded position. One advantage of TPR and other materials in this class is that they include better "memory" and may be stretched and expanded with reduced risk of compromising an integrity of balloon 305. In the case of remote actuators that include elastic, non-deforming expansions (e.g., the cavity-defining walls do not themselves stretch or expand), the actuating mechanism may be calibrated to provide a different (e.g., increased) quantity of air as compared to an elastic deformable remote actuator. (For example, a deformable remote actuator would be one that includes an expandable/collapsible balloon that increased capacity as air flows in and decreases capacity as air exits.)

One advantage of remote actuator 300 is that it includes self-biasing features and no additional memory spring or the like is necessary to aid deflation when deactuating. Other embodiments may use variations of remote actuator 300 for actuating one or more of the moveable elements. Further, these elements may be constructed in many different ways. One variation for an inexpensive actuating active element includes a blow-molded bladder in which heat or the like is used to preform the bladder into a "memorized" configuration appropriate for an unactuated mode, similar in visualization to remote actuator 300. Air effects operating on such a bladder straightens it to an actuated mode which will automatically transition to the unactuated mode when the actuating air effect is released.

As illustrated in FIG. 3, remote actuator 300 includes a fixed portion (e.g., a proximal end nearest actuating port 310) attached to the article and a moving portion (e.g., a distal end at an end opposite of the proximal end) moveably coupled to the fixed portion by a fold region. In some implementations, the moving portion includes one or more additional folds to produce an extendable remote actuator, these optional additional folds may be inward or outward folds.

Figures 4, 5:
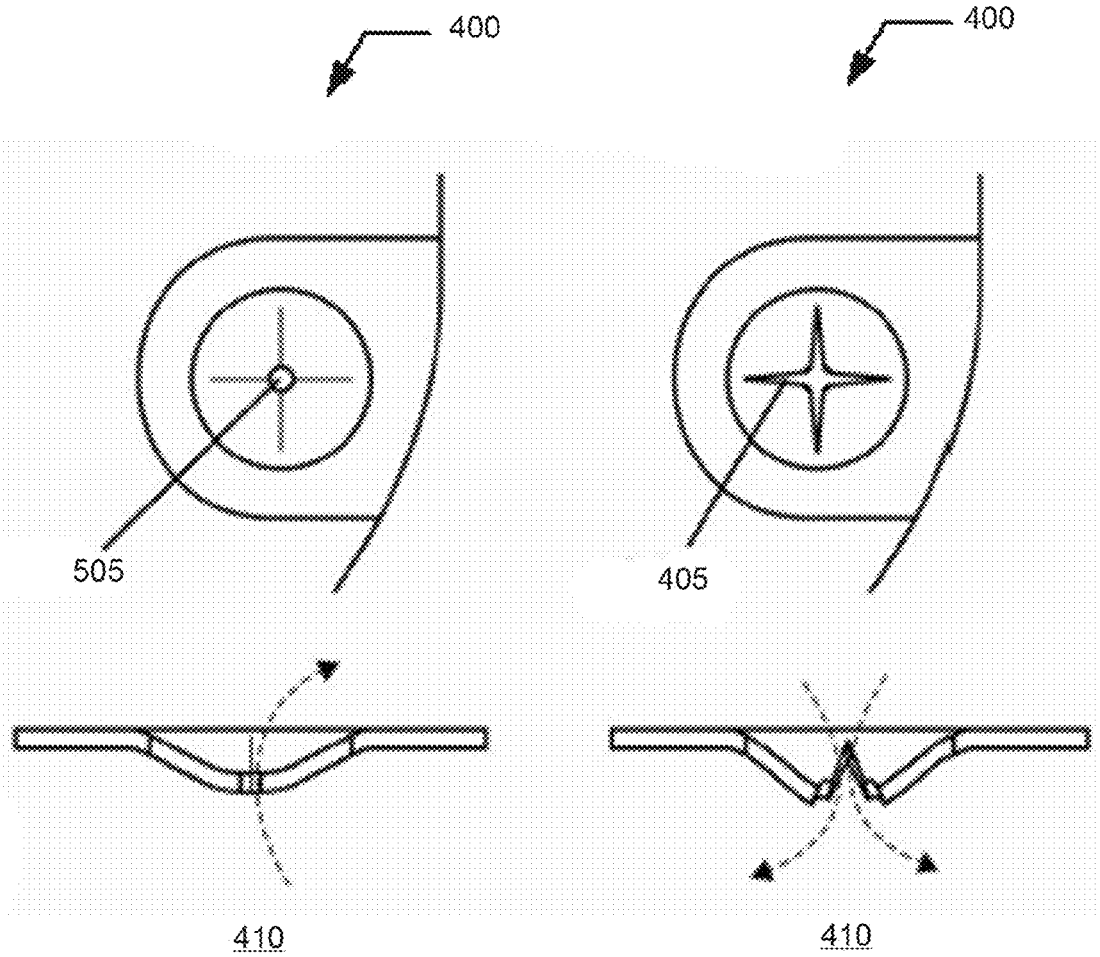
FIG. 4 and FIG. 5 illustrate a modified valve that includes an optional bleed mechanism.

FIG. 4 and FIG. 5 illustrate a modified valve 400 with a valving structure 405 that includes an optional bleed mechanism 505. FIG. 4 illustrates valve 400 open an allowing air into an air reservoir 410 and FIG. 5 illustrates valve 400 closed with optional bleed mechanism 505 bleeding air from air reservoir 410. Air reservoir 410 may include one or more of the actuating mechanism, the remote actuator, and/or the conduit coupling the elements together.

Valve 400 may be a type of one-way valve, allowing quick intake and slow release of air into and out of reservoir 410. Valve 400 is, in a preferred embodiment, a simple cross-cut in a molded air-bladder. An optional small hole provides bleed mechanism 505 coupled with the cross cut (for example placed at a bottom of a concave divot) to provide variable airflow control. Valve 400 in the closed mode includes the optional small hole for slow release. Valve 400 in an open mode has a larger aperture (e.g., open cross-cut) for increased air intake. In some implementations, valve 400 may include a layer of open cell foam or other air-permeable material overlying the cross-cut to help produce a one-way valving effect.

Figure 6:
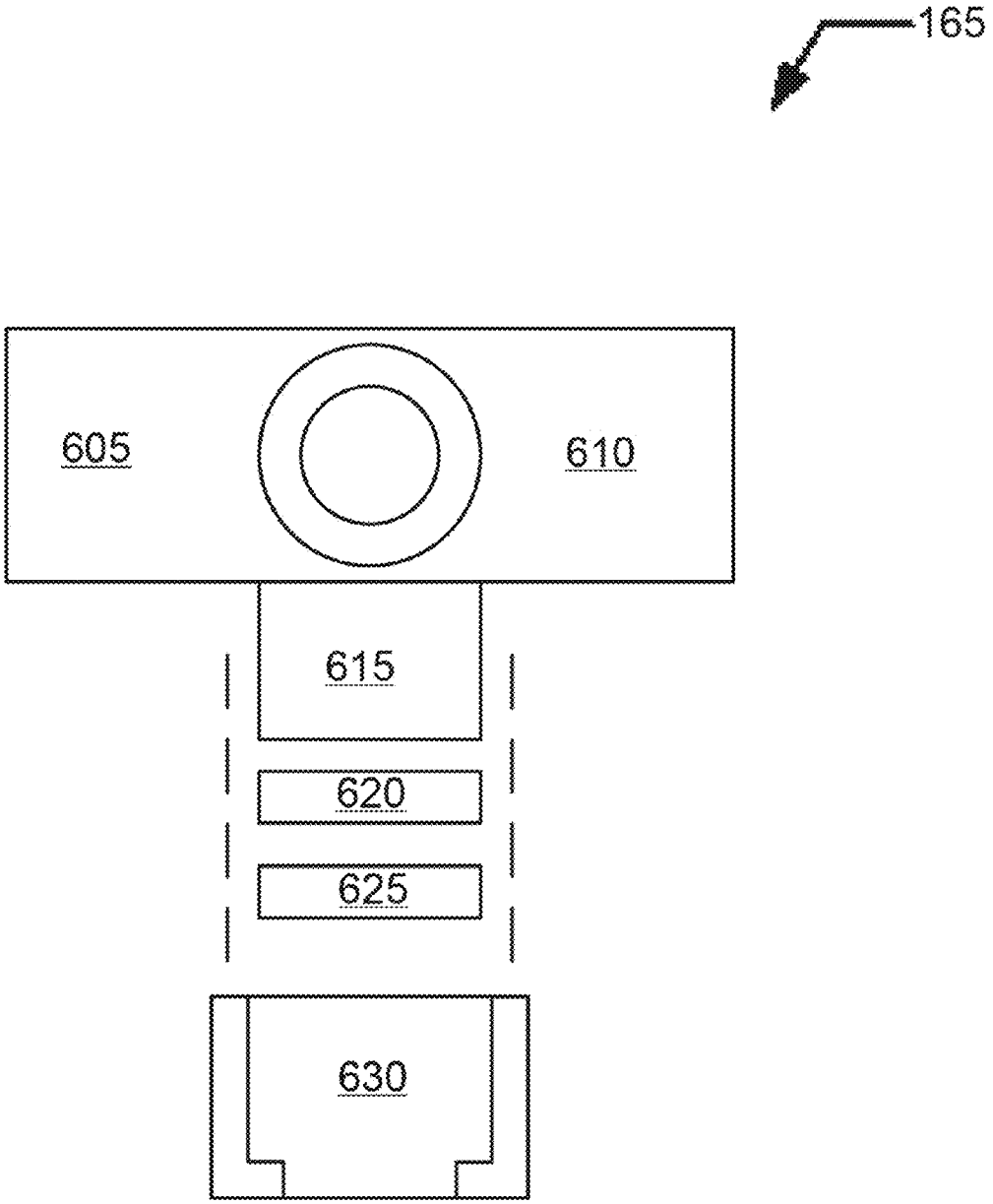
FIG. 6 illustrates an exploded view of the intake valve assembly shown in FIG. 2.

FIG. 6 illustrates an exploded view of intake valve assembly 165 that could be used in FIG. 1 and FIG. 2. Intake valve assembly 165 includes a first port 605, a second port 610, an aperture 615, a fabric layer 620, a rubber diaphragm 625, and a cap 630. Fabric layer 620 permits air leakage/flow through the refill mechanism.

First port 605 may be coupled to actuating mechanism 150 and second port 610 may be coupled to conduit 160 as shown in FIG. 1. Airflow between first port 605 and second port 610 is two-way. Airflow from first port 605 and aperture 615 or second port 610 and aperture 615 is one-way (i.e., from the aperture to either of the ports). In some implementations, such as shown in FIG. 6, the construction of intake valve assembly 165 includes the bleed mechanism as described herein to allow fast intake and slow outflow of air with respect to ambient.

Figure 7:
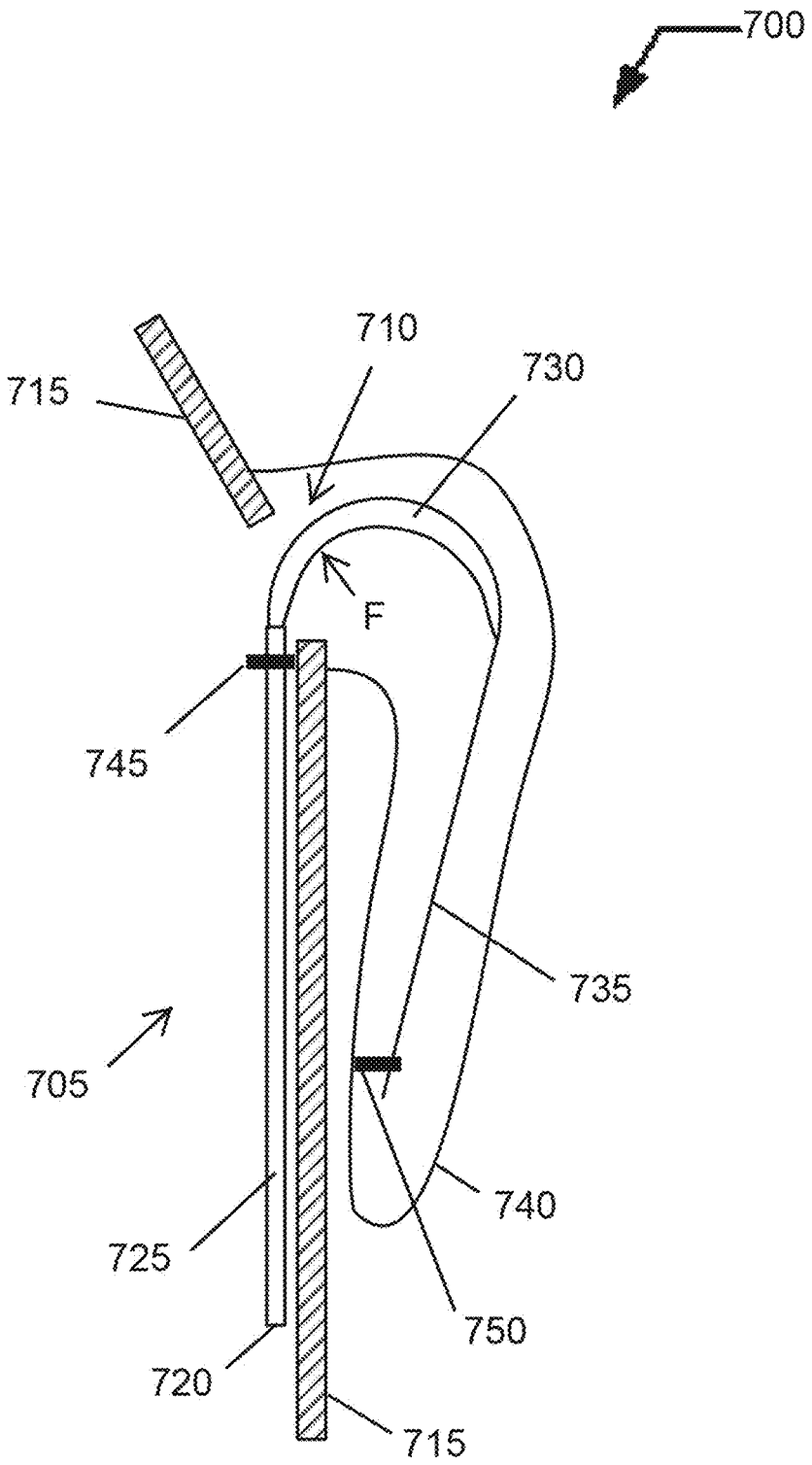
FIG. 7 illustrates a section of the active container where a remote actuator passes through an aperture in the outside layer of the head portion.

FIG. 7 illustrates a section 700 of the active container described herein where a remote actuator 705 passes through an aperture 710 in an outside layer 715 of container portion 105, or over an edge of container portion 105 forming a portion of the opening into holding volume 110. Remote actuator 705 is a variation of remote actuator 300 in terms of arrangement, and except where the following content indicates otherwise, remote 705 conforms to the structural and operational details associated with remote actuator 155 and remote actuator 300 described herein.

Remote actuator 705 includes an actuating port 720, a channel portion 725, an actuating balloon portion 730, and an extension portion 735. A sheath 740 encloses those portions of remote actuator 705 outside of outside layer 715. An actuator anchor attachment 745 (e.g., anchor stitching, staples, tacks, and the like with stitching preferred) secures balloon portion 730 into its desire orientation which is where folding and unfolding (e.g., fold region F) occur primarily and in the illustrated embodiments exclusively outside of outside layer 715.

In this implementation, balloon portion 730 begins at or near anchor attachment 745 and is configured to curve up immediately into and through aperture 710 to maximize folding/unfolding region outside of outside layer 715. This inhibits/resists binding or obstruction of operation of remote actuator 705.

A flapper anchor attachment 750 is preferably positioned, for example by appropriate sizing of extension portion 735, as close to a distal end of sheath 740 as possible without degrading operation. Flapper anchor attachment 750 helps to maintain fold region F in the desired position and resists relative shifting/motion of remote actuator 705 as compared to aperture 710.

The capacities of the air volumes and rates of inflow and bleeding are tuned to achieve the level of responsiveness in actuating the moveable elements. A relative volume of air between the actuating mechanism and the controlled remote actuators, along with a distance between the structures influences a magnitude of motion (e.g., how much unfolding). How quickly the refill assembly is able to refill the actuating mechanism helps influence how quickly the user is able to repeat a motion of a moveable element. It is important that the bleed mechanism not be so large as to interfere with unfolding or so small that the moveable elements are "locked" in the unfolded configuration.

In the alternate embodiments of FIG. 8-FIG. 13, the actuating mechanisms illustrated and described in the context of FIG. 1-FIG. 7 are used while being appropriately rearranged and repurposed. Other rearrangements in addition to these are also possible implementations of the present invention.

Figure 8:
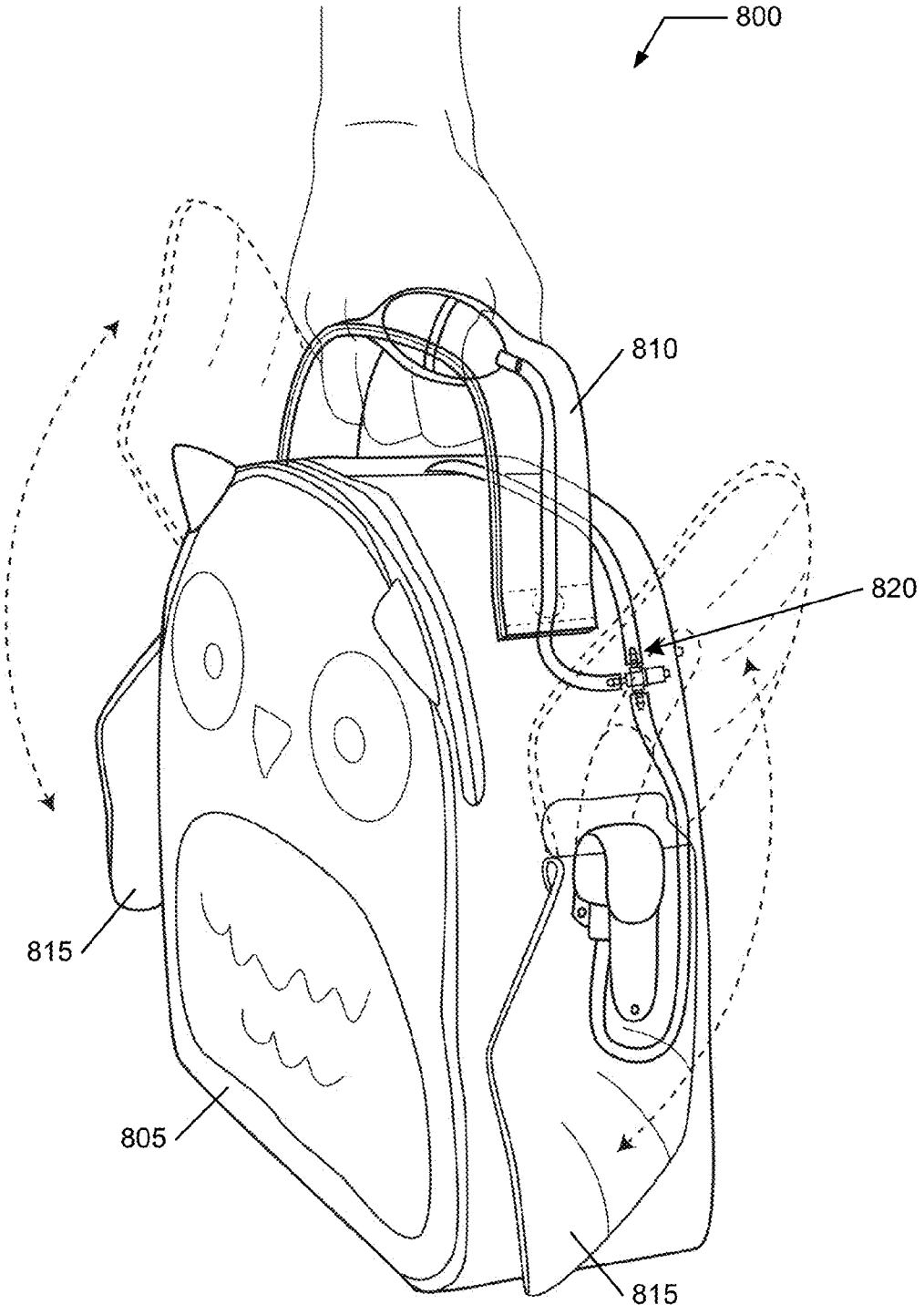
FIG. 8 illustrates a perspective view of an alternate active container having one or more moveable elements arranged into a thematic configuration.

FIG. 8 illustrates a perspective view of an alternate active container 800 having one or more moveable elements arranged into a thematic configuration. Container 800 represents a portable resealable/reclosable (e.g., use of a zipper, buckles, snaps, fasteners, or the like) lunch box type article of manufacture which includes a body container 805, an attached handle 810 and one or more moveable elements 815. Moveable elements 815 are responsive to an actuator assembly 820 which is a reconfiguration of actuator assembly 140 illustrated and described herein. Moveable elements 815 are alternatively illustrated as a set of solid lines for an unactuated mode and as a set of dashed lines for an actuated mode. One or more actuating mechanisms (for example a bulb disposed inside of handle 810) controls a transition of moveable elements 815 from the unactuated mode to the actuated mode. The air-powered actuators of actuator assembly 820 are biased to transition back to the unactuated mode.

As illustrated in FIG. 8, a bird theme (e.g., an owl) may include a set of static components representing eyes, body, beak disposed on body container 805 with moveable elements 815 configured to represent a set of wings. In this example, a single bulb concurrently actuates a pair of moveable elements 820 (e.g., wings) by concurrent operation of a pair of air-powered ac. Other implementations may operate other moveable elements configured/associated with different thematic element or elements (e.g., a "front" beak in addition or in lieu of lateral wings) and may include multiple bulbs for other-than-concurrent operation (or selective operation) of some air-powered actuators.

As illustrated, actuator assembly 820 is hidden under an outer shell of components of container 800, including having the air-powered actuators disposed within a sheath (e.g., fabric) that is attached to container body 805. Some implementations may reveal some or all components of actuator assembly 820. Alternatives described in the context of FIG. 1-FIG. 7 may also be applicable to the embodiments described in the context of FIG. 8.

Figure 9:
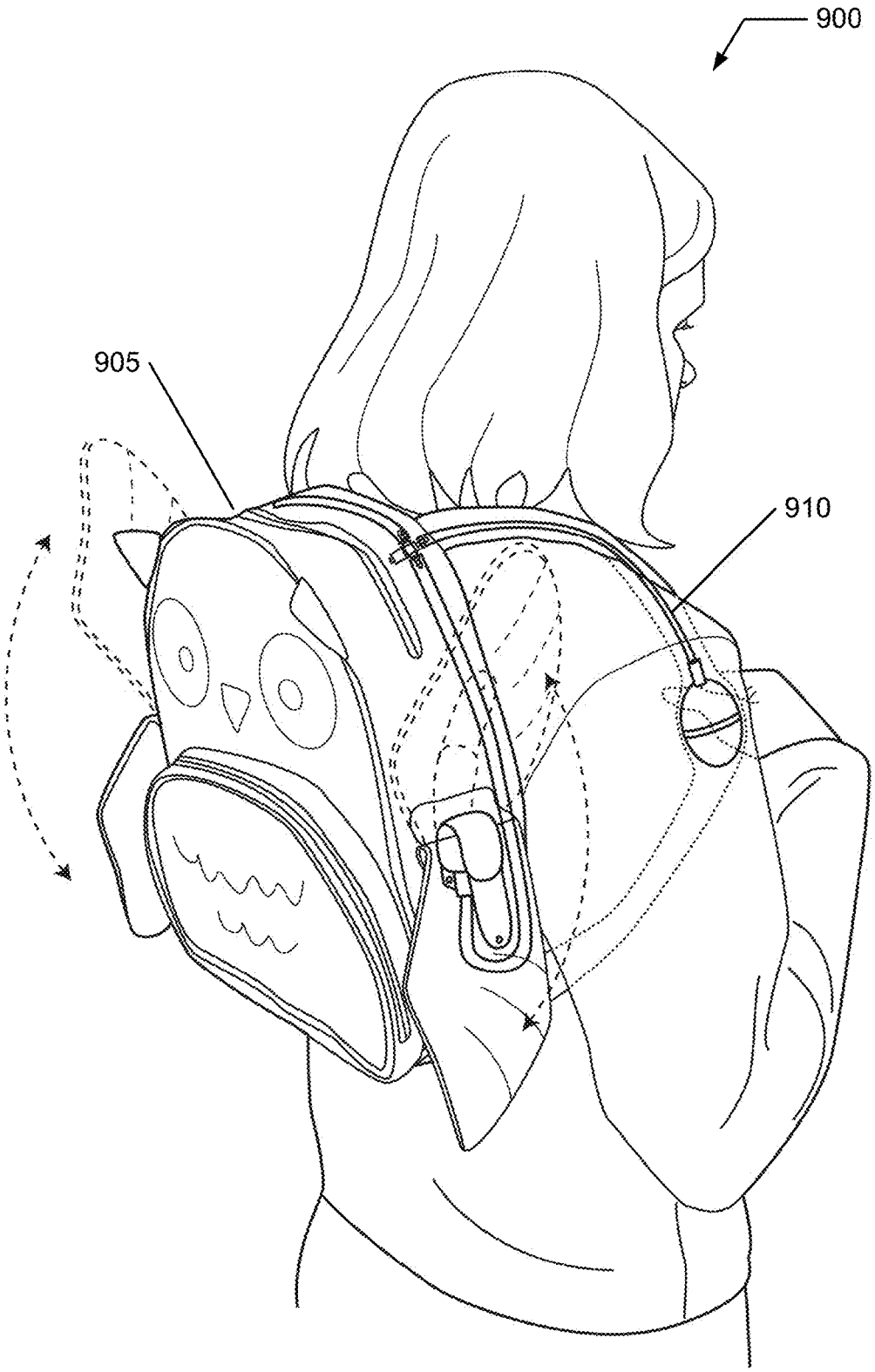
FIG. 9 illustrates a perspective view of an alternate active container having one or more moveable elements arranged into a thematic configuration.

FIG. 9 illustrates a perspective view of an alternate active container 900 having one or more moveable elements arranged into a thematic configuration. Container 900 is configured operationally similarly to container 800 except that handle 810 has been replaced with a set of should straps 910, including use of a similar owl theme. A bulb of the actuator assembly is disposed inside a strap 910 in a location where the user may operate the moveable elements while container 900 is worn on a back of the user and straps 910 pass over shoulders. The position may be located at or near a top/forward portion of shoulder where the user may naturally rest a hand when gripping a strap passing over the shoulder (that is a right hand reaches a bulb disposed in strap 910 passing over a right shoulder). Alternatively a user may reach across the body and operate a bulb disposed in a strap crossing an opposite shoulder (the right hand reaching a bulb disposed in a left-hand side strap 910). Alternatives described in the context of FIG. 1-FIG. 8 may also be applicable to the embodiments described in the context of FIG. 9. An actuating bulb may be located virtually anywhere along a part of strap 910 at the front of the body, including a location where a hand is positioned in FIG. 11 described later.

Figure 10:
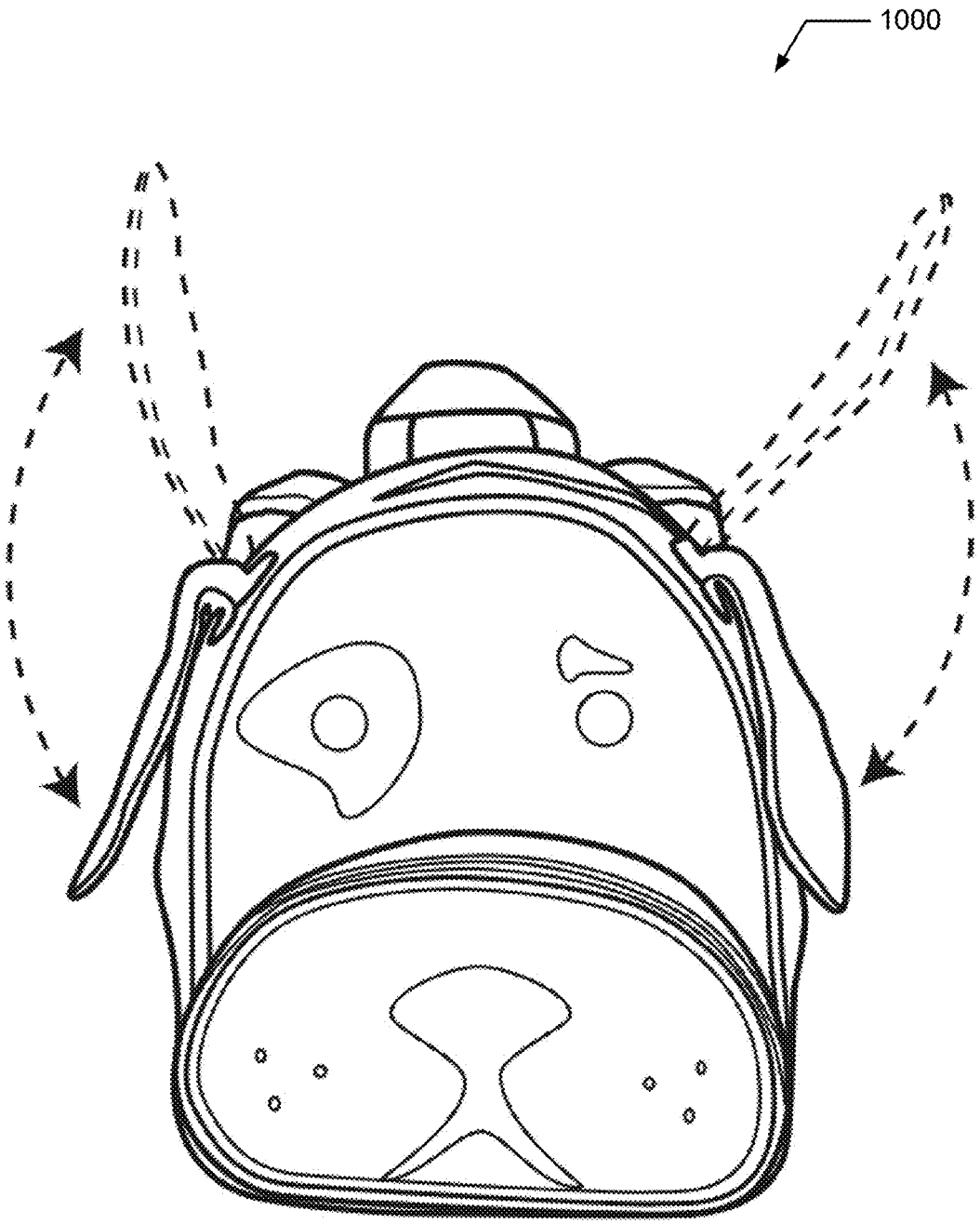
FIG. 10 illustrates an elevation view of the alternate active container of FIG. 9 having the one or more moveable elements arranged into an alternate thematic configuration.

FIG. 10 illustrates an elevation view of an alternate active container 1000 based upon container 900 having the one or more moveable elements arranged into an alternate thematic configuration. Except for the thematic change (with the possibility of reconfiguration/reassociation/repositioning of components of the actuator assembly), container 1000 is arranged and operates as described in the context of container 900. Specifically, container 1000 includes a "puppy" thematic configuration instead of the "owl" thematic configuration. The puppy thematic configuration includes static components representative of a puppy face (e.g., eyes and muzzle) and moveable elements configured as puppy ears that are raised when actuated by operation of the actuating mechanism.

Figure 11:
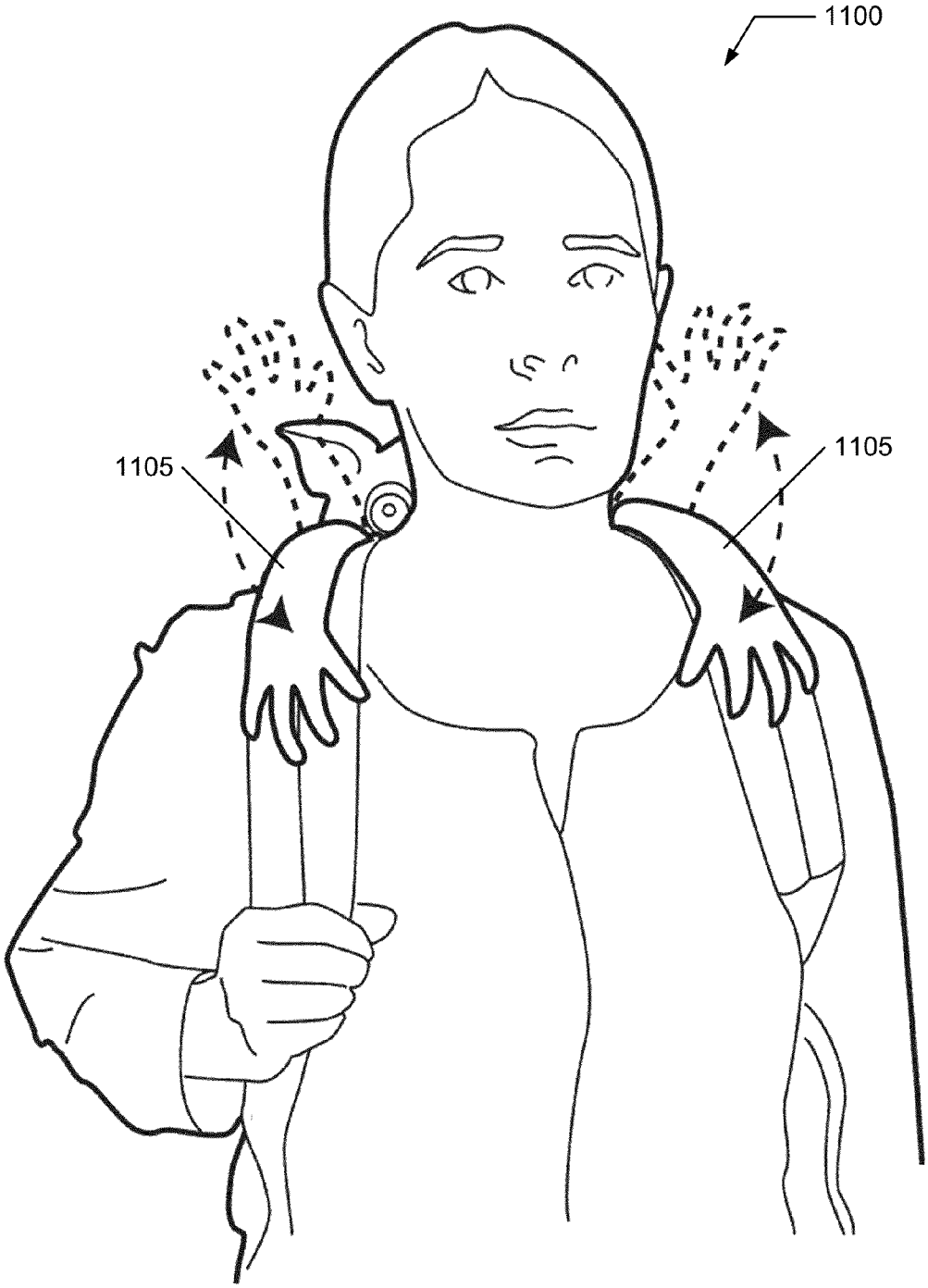
FIG. 11 illustrates a perspective view of the alternate active container of FIG. 9 having the one or more moveable elements arranged into an alternate thematic configuration.

FIG. 11 illustrates an elevation view of an alternate active container 1100 based upon container 900 having the one or more moveable elements arranged into an alternate thematic configuration. Except for the thematic change (with the possibility of reconfiguration/reassociation/repositioning of components of the actuator assembly), container 1100 is arranged and operates as described in the context of container 900. Specifically, container 1100 includes an alternative thematic configuration instead of the "owl" thematic configuration. The alternative thematic configuration repositions a pair of moveable elements 1105 configured as arms that are arranged to lay on the straps 910 when in an unactuated modes. These arms are raised when actuated by operation of the actuating mechanism. The raised arms extend upward from the container body and are preferably visible from a position in front of the user, such as shown in FIG. 11. When the actuating mechanism is released, the self-biasing features of the air-powered actuators lower and return the arms to the unactuated position, for example resting on the top of the shoulder straps. Other thematic moveable elements of the backpack worn on the back of the user may be similarly operated to be visible from a position in front of the user. In some implementations, the moveable elements may be visible from the side or other relative location to the user rather than raised and extending from behind the shoulders.

Figure 12:
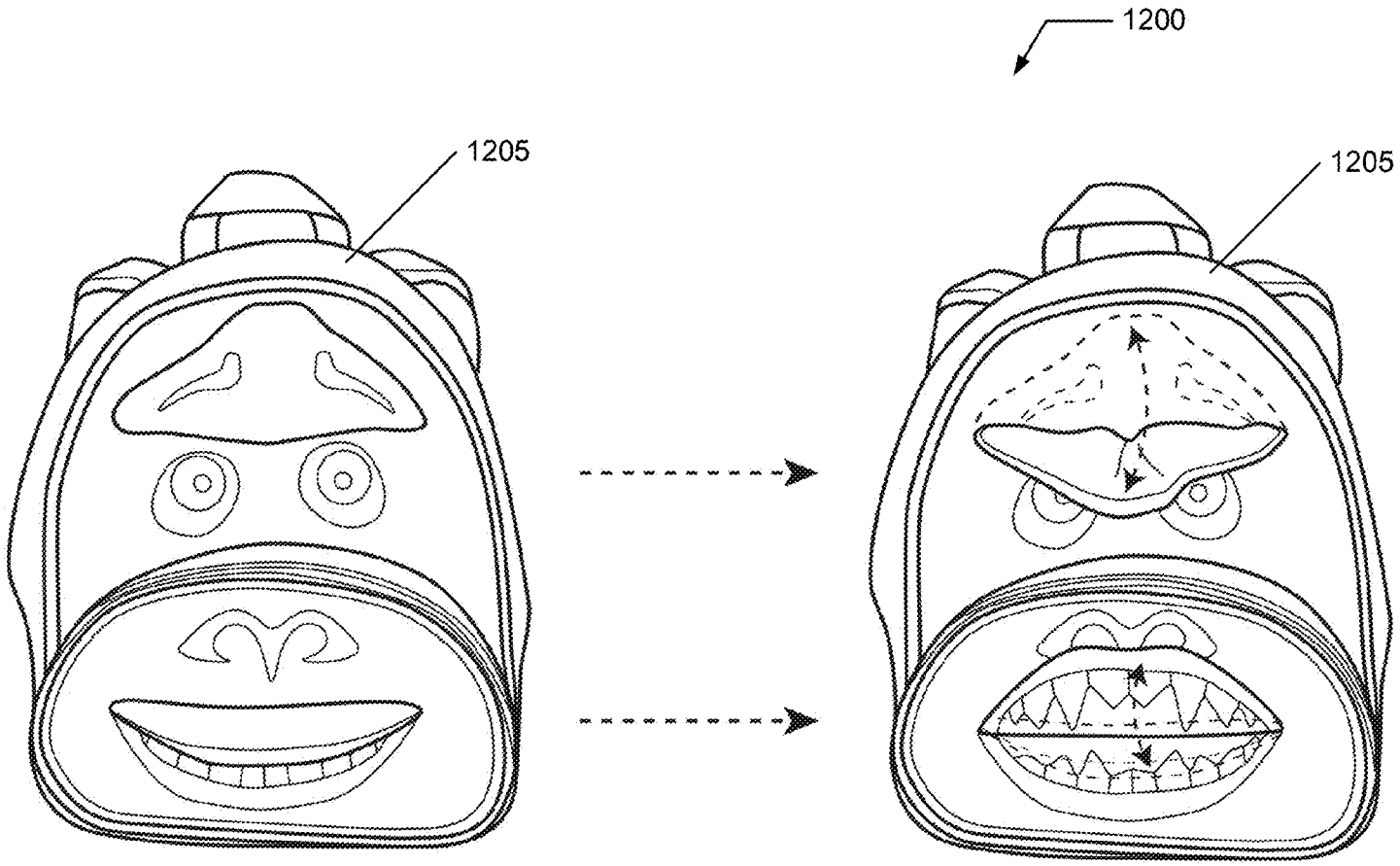
FIG. 12 illustrates a pair of elevation view of the alternate active container of FIG. 9 having the one or more moveable elements arranged into an alternate thematic configuration and further illustrating transitions of the one or more moveable elements.

FIG. 12 illustrates a transition sequence 1200 of an active container 1205 based upon container 900 having the one or more moveable elements arranged into an alternate thematic configuration. Except for the thematic change (with the possibility of reconfiguration/reassociation/repositioning of components of the actuator assembly), container 1205 is arranged and operates as described in the context of container 900. Specifically, container 1205 includes an "Hominidae" thematic configuration instead of the "owl" thematic configuration. The hominidae thematic configuration includes static components representative of a hominid face (e.g., eyes, nose, and mouth) and moveable elements configured as lips and brow that are moved concurrently when actuated by operation of the actuating mechanism. In the illustration of FIG. 12, the unactuated mode is illustrated on the left and the actuated mode on the right. The unactuated mode includes a lowered upper lip and a raised brow. Actuation raises the upper lip and lowers the brow. Deactuation reverses this in response to the self-biasing features to lower the upper lip and raise the brow. Other movements and arrangements as appropriate to the thematic configuration and desired motion of the associated moveable element is possible by use of the actuating assembly and its actuating mechanism and air-powered actuators operating the moveable elements.

Figure 13:
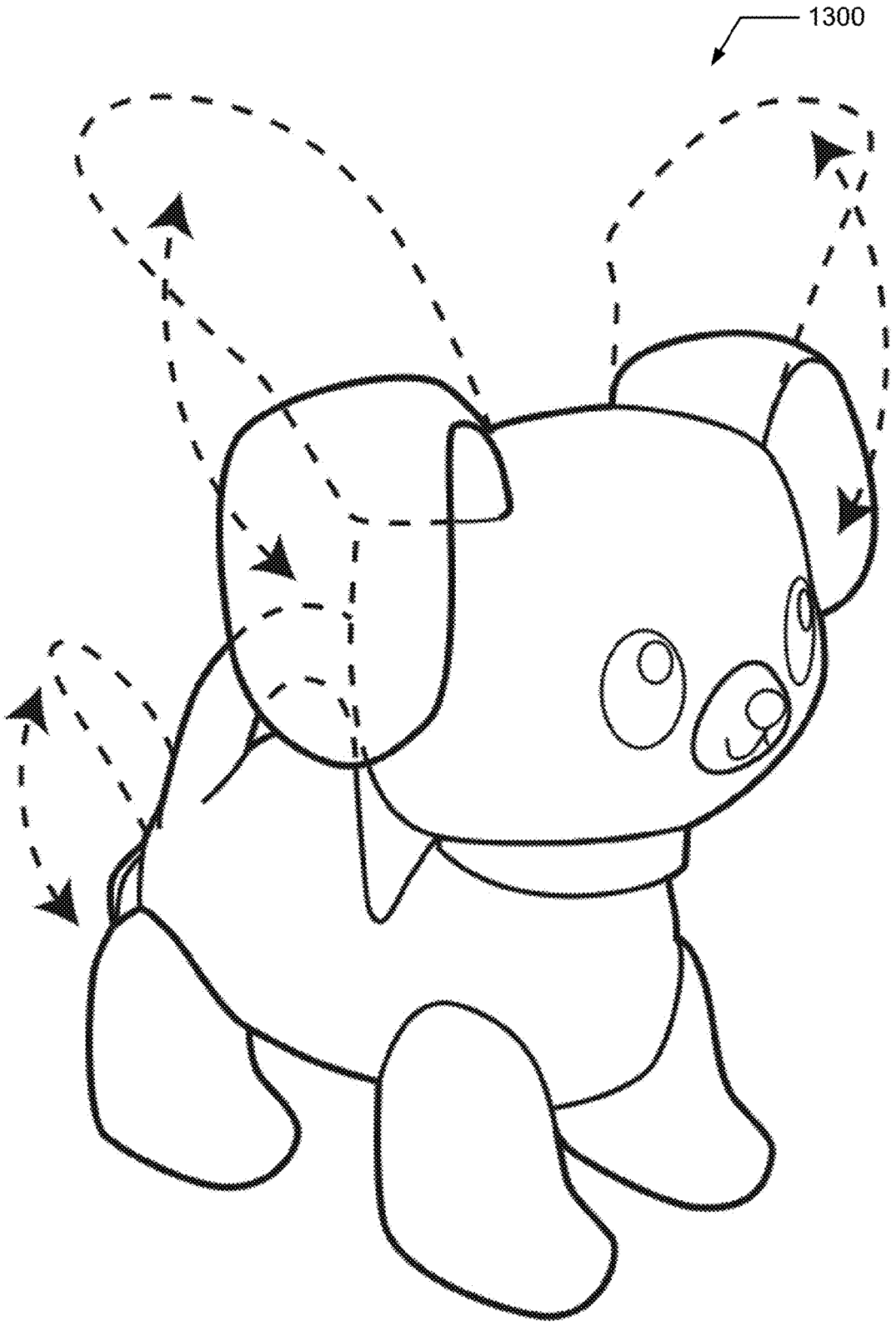
FIG. 13 illustrates a perspective view of a plush animal having one or more moveable elements arranged into a thematic configuration.

FIG. 13 illustrates a perspective view of a plush toy 1300 having one or more moveable elements arranged into a thematic configuration for a stuffed animal. Toy 1300 includes a body and a number of appendages/protuberances. Some of the protuberances (e.g., a tail and one or more ears) are moveable elements responsive to an embedded actuating assembly as described herein. An actuating mechanism may be disposed in the body itself and/or in one of the appendages/protuberances (e.g., head or foot). Air-powered actuators that are responsive to the actuating mechanism operate the moveable elements between a self-biased unactuated mode and an actuated mode. There are many different thematic configurations for the general arrangement of toy 1300. As illustrated, fabric or plush sheaths define the moveable elements and encase and conceal the air-powered actuators. Some implementations may include a user-accessible body cavity through a reclosable opening, such as a zipper or other closure system.

Figure 14:
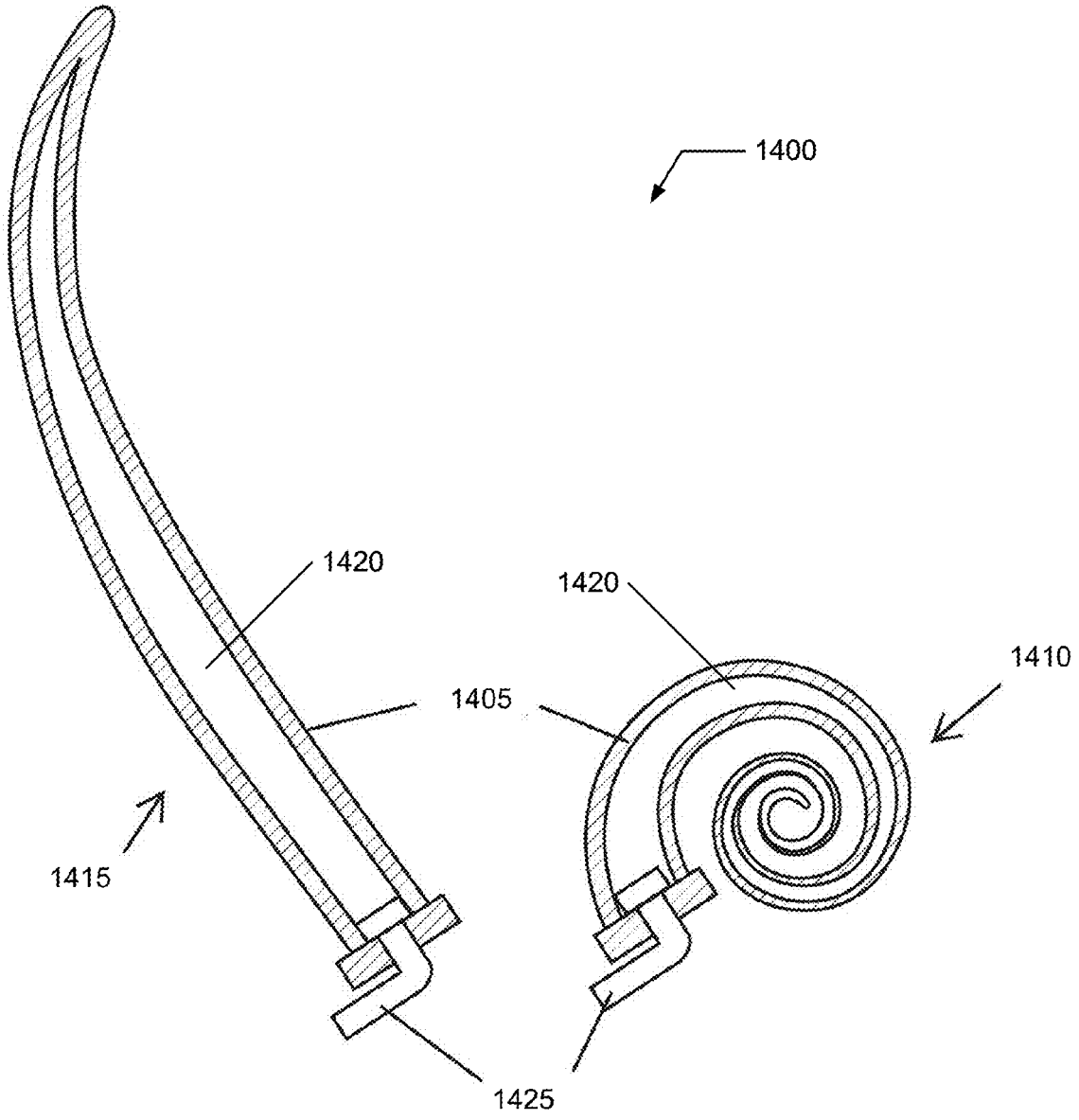
FIG. 14 illustrates a series of side plan views of an rolling/unrolling operational sequence for an air-powered actuator for use with the themed fanciful air-powered active container articles described herein.

FIG. 14 illustrates a series 1400 of side plan views of a rolling/unrolling operational sequence for an air-powered actuator 1405 for use with the themed fanciful air-powered active articles described herein in FIG. 1-FIG. 13. Actuator 1405 may be used as a substitute to actuator 300 illustrated in FIG. 3 appropriate to the thematic configuration and desired motion of the moveable element(s). These actuators may be implemented as thermoplastic rubber (TPR), blow-molded plastic, or other material. As noted herein, in many preferred implementations, the actuators have a self-biased configuration to return to a predictable unactuated mode due to the material and manufacturing process. Not all implementations will have or require the self-biasing configuration (e.g., no bias or use of a separate biasing element/assembly).

Series 1400 of actuator 1405 includes transitions from a self-biased unactuated mode 1410 to an extended actuated mode 1415. Series 1400 includes mode 1410 as a rolled/furled/curled structure (e.g., a rolling tongue—a furling/unfurling tongue) that unrolls/unfurls/uncurls to actuated mode 1415 in response to air/air pressure communicated from the actuating mechanism to an internal cavity 1420 via an air port 1425. Release of the air/air pressure results in an automatic and repeatable transition from actuated mode 1415 to unactuated mode 1410 responsive to the self-biasing features. Actuator 1405 rolls out when inflated to provide an extended tongue and rolls up when deflated to provide a retracted tongue.

One advantage of TPR and other materials in this class is that they include better "memory" and may be stretched and expanded with reduced risk of compromising an integrity of the active element. In the case of active elements that include elastic, non-deforming expansions, the air bladder may be calibrated to provide a different (e.g., increased) quantity of air as compared to an elastic deformable active element.

The actuators described herein, including actuator 1405, may be implemented as non-actuating elements that are visually modified for direct use in an amusement system. One advantage of these structures is that they include self-biasing features and no additional memory spring or the like is necessary to aid deflation when deactuating. Other embodiments may use these actuators as actuating active elements. Further, these elements may be constructed in many different ways. One variation for an inexpensive actuating active element includes a blow-molded bladder in which heat or the like is used to preform the bladder into a "memorized" configuration appropriate for an unactuated mode, similar in visualization to second active element Air effect operating on this bladder straightens it to an actuated mode which will automatically transition to the unactuated mode when the actuating air effect is released. The actuator may also be enclosed/concealed in a sheath or assembly (fabric, plush or the like) to hide the mechanical structures and enhance the thematic configuration.

Figure 16:
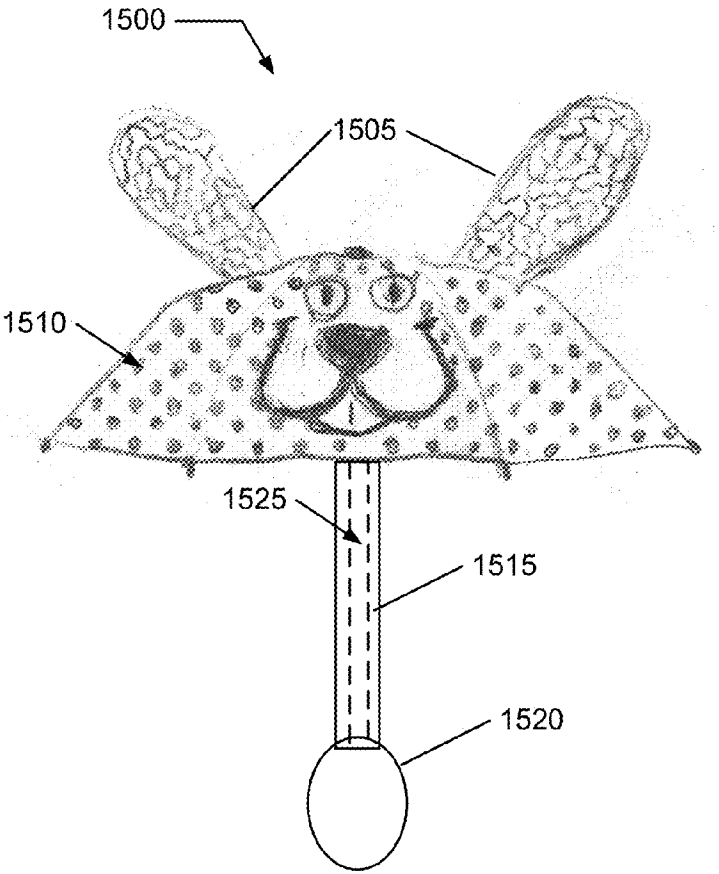
FIG. 15-FIG. 24 illustrate portable handle-held canopies having one or more moveable elements.
Figure 15:
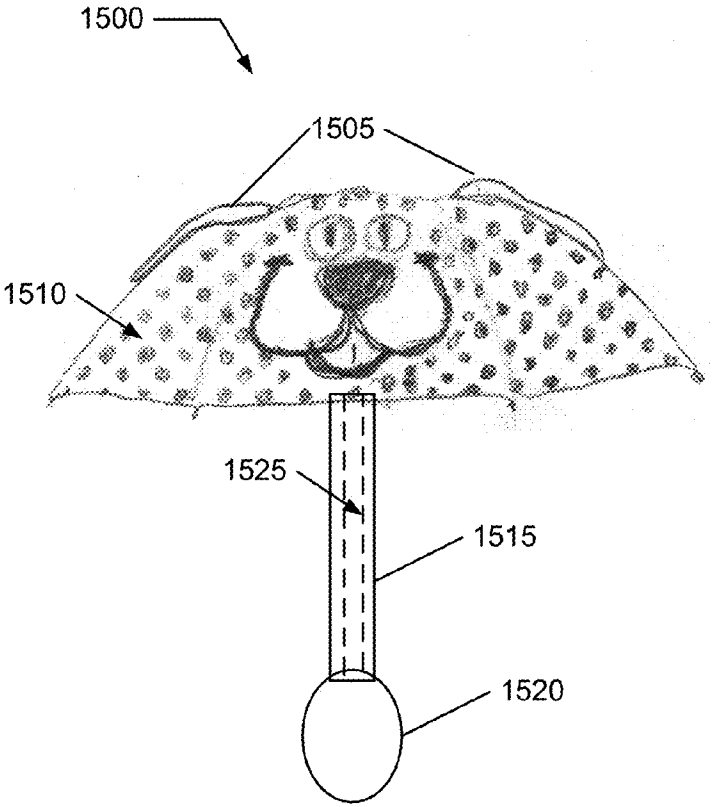

Canopies:

FIG. 15-FIG. 24 illustrate portable handle-held canopies having one or more moveable elements; FIG. 15-FIG. 16 illustrate a puppy thematic embodiment of a hand-held canopy 1500 having a pair of moveable ears 1505. FIG. 15 illustrates hand-held canopy 1500 in an unactuated mode with ears 1505 unactuated in a retracted position and FIG. 16 illustrates hand-held canopy in the actuated mode with ears 1505 actuated in an extended position. Each ear 1505 is coupled to an actuator (not shown) that controls the positions responsive to a user operating a mode control system. Hand-held canopy 1500 includes a canopy cover 1510 operated by a folding/collapsing internal framework as well-known. This framework is supported by a central shaft 1515. Canopy 1500 additionally includes a bladder 1520 coupled to a conduit 1525 extending through shaft 1515 to a distribution manifold (not shown) that is communicated in turn to the actuator(s) that operate(s) the moveable element(s) (i.e., ears 1505 of canopy 1500, though other embodiments include different moveable element(s)). Bladder 1520 may be incorporated into a handle or other operable structure attached to, or integrated with, shaft 1515. It is preferred that components of the actuating mechanism, such as the actuators, conduits, and manifold(s), be concealed or inaccessible to a user for visual appeal and to reduce risks that one or more of these components will be damaged during use. A benefit of the illustrated embodiment is that the moveable elements are operable whether the canopy is extended/expanded or retracted/contracted responsive to the operation of the underlying framework. The control mechanism of moveable ears 1505 is independent of the canopy operation.

Two major categories of portable hand-held canopies are umbrellas and parasols. The umbrella typically includes canopy cover 1510 made from a rain-resistant/waterproof material and construction while a parasol embodiment includes canopy cover 1510 made from an opaque/sunproof material and construction. Some implementations may function in both roles while an umbrella typically of sturdier construction and materials as inclement weather may also include significant wind and other environmental conditions that suggest use of more robust materials and construction. This is in contrast to the parasol often understood to be appropriate in fair weather.

As noted herein, there are many different implementations and arrangements for the actuator components. The discussion with respect to FIG. 1-FIG. 14 may be adapted for use with the canopy implementations, including arrangements, operations, and functions of the actuators and other components. For example, some implementations may include a single moveable element, while other implementations include multiple elements (e.g., 2-10 elements or more). Multiple elements may be controlled together using one bladder actuator or grouped into two or more independent groups with the actuators of each group controlled together with other actuators of the group.

The actuators are preferably implemented using air pressure changes initiated from bladder 1520 and propagated along the conduits communicating the bladder to the associated actuator(s). While some implementations may include wholly closed systems in which air does not escape or enter into the actuator control system, the illustrated embodiments include a lossy system in which air is anticipated to enter and exit the actuator control system. The use of the refill mechanism for selectively allows air to re-enter during refilling (e.g., when the actuators are transitioning from the extended to the retracted positions and/or the bladder is expanding automatically after being collapsed) while resisting diverting air out of the actuator system when the actuator is transitioning from the retracted position to the extended position.

As noted, there are many different motions that may be implemented by the actuators, such as folding/unfolding, furling/unfurling, collapsing/expanding. For improved visual effects, canopy 1500 includes a thematic configuration in which the moveable elements contribute to the theme: ears for a puppy, fins for a fish, wings for an owl, a tail for a fox, and the like. The user-controlled operation of the moveable element(s) is enhanced when the hardware associated with the actuating components is concealed within façades consistent with the theme. The façade may be cloth, fabric, or other material that is configured to not interfere with the operation of the underlying actuator (e.g., it is flexible and/or stretchy).

Figure 18:
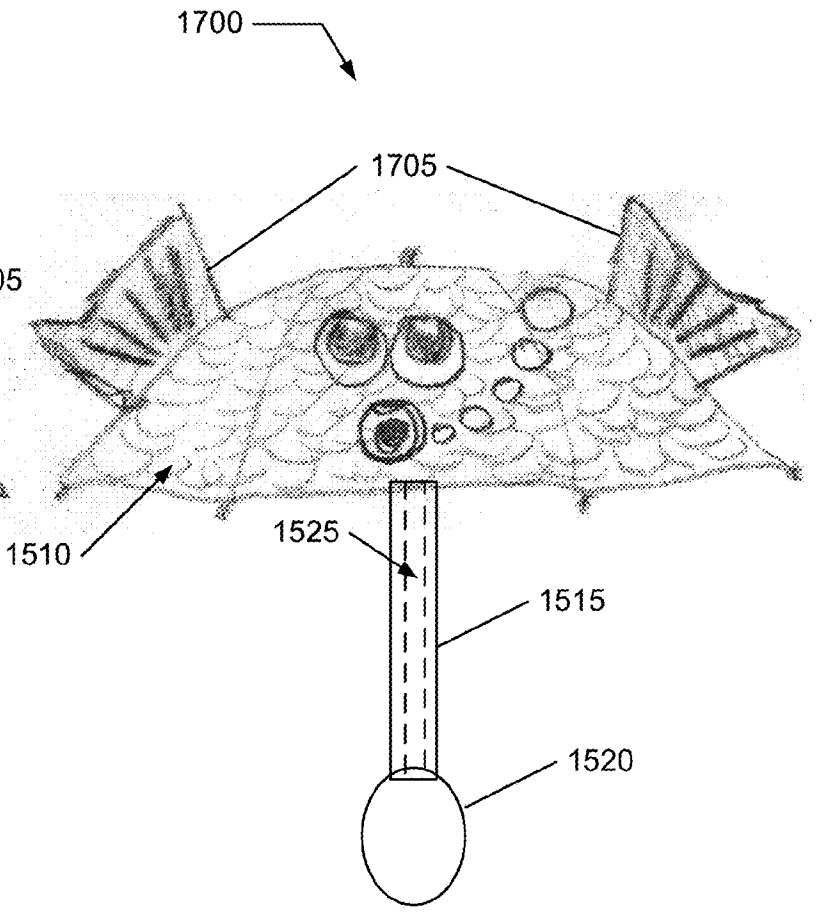
Figure 17:
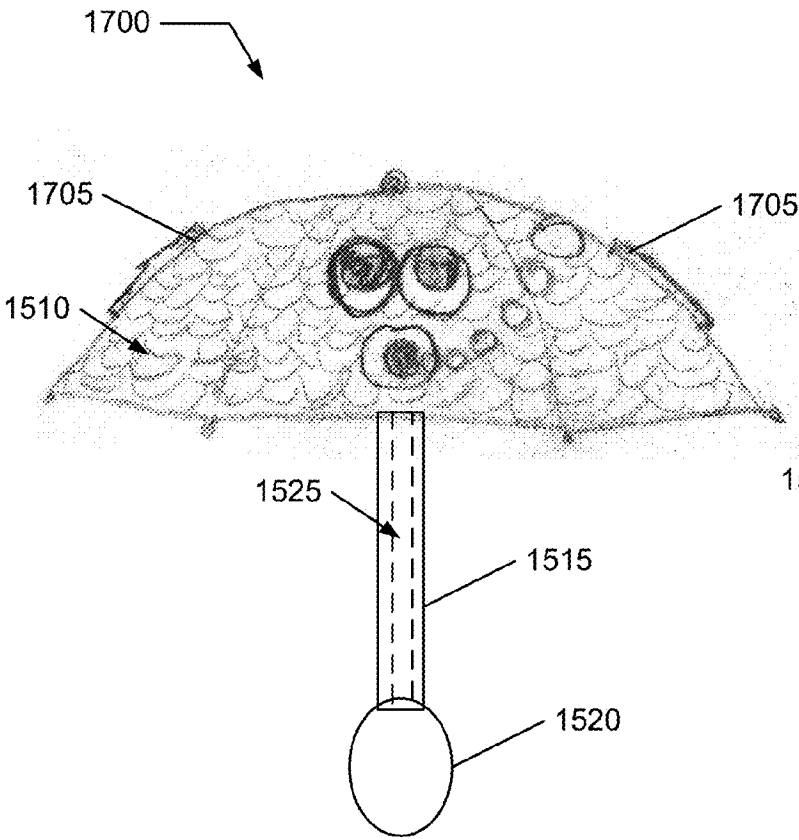

FIG. 17-FIG. 18 illustrate a fish thematic embodiment of a hand-held canopy 1700 having moveable fins 1705. FIG. 17 illustrates hand-held canopy 1700 in an unactuated mode with fins 1705 in an unactuated mode and retracted and FIG. 18 illustrates hand-held canopy 1700 in the actuated mode with fins 1705 in an actuated mode and extended. Except for the thematic differences and consequent rearrangement and repositioning of actuators, canopy 1700 structurally and operationally corresponds to hand-held canopy 1500.

Figure 20:
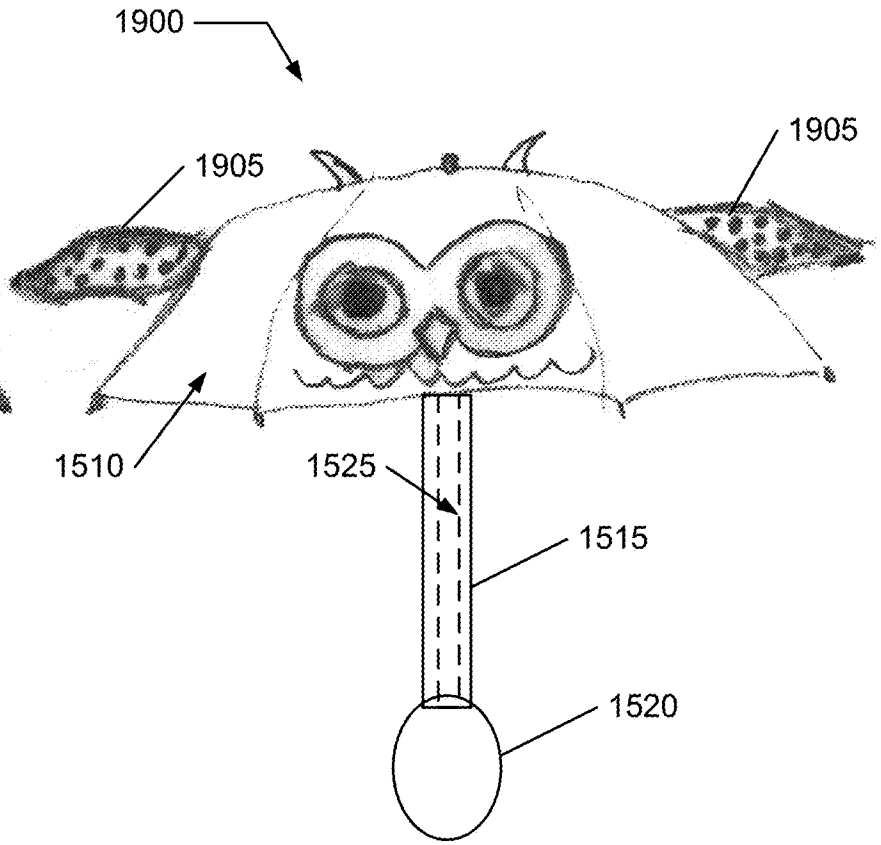
Figure 19:
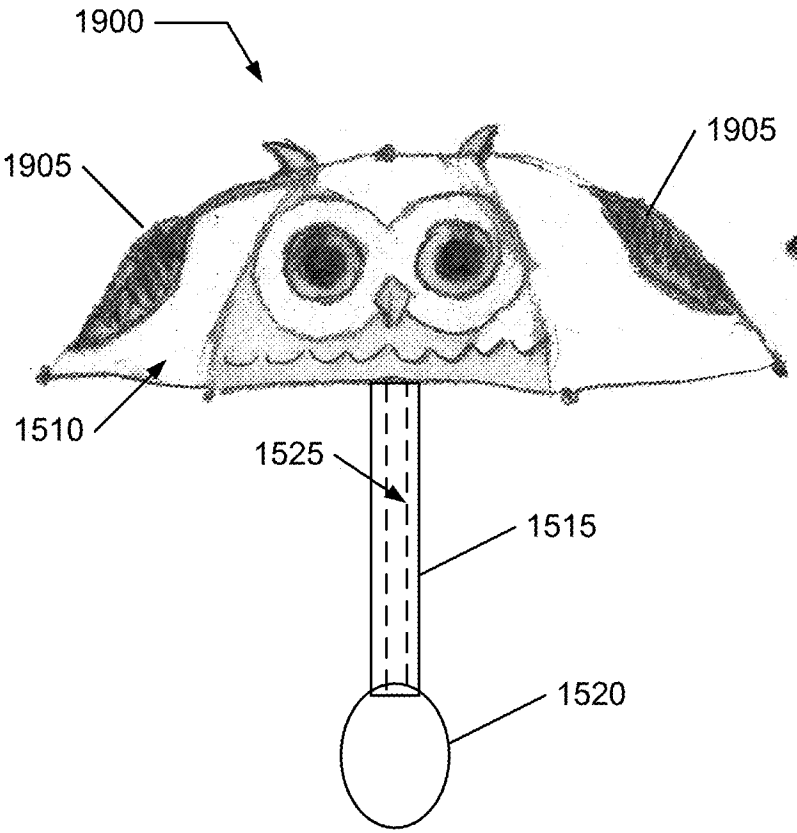

FIG. 19-FIG. 20 illustrate an owl thematic embodiment of a hand-held canopy 1900 having moveable wings 1905. FIG. 19 illustrates hand-held canopy 1900 in an unactuated mode with wings 1905 in an unactuated mode and retracted and FIG. 20 illustrates hand-held canopy 1900 in the actuated mode with wings 1905 in an actuated mode and extended. Except for the thematic differences and consequent rearrangement and repositioning of actuators, canopy 1900 structurally and operationally corresponds to hand-held canopy 1500 and hand-held canopy 1700.

Figure 22:
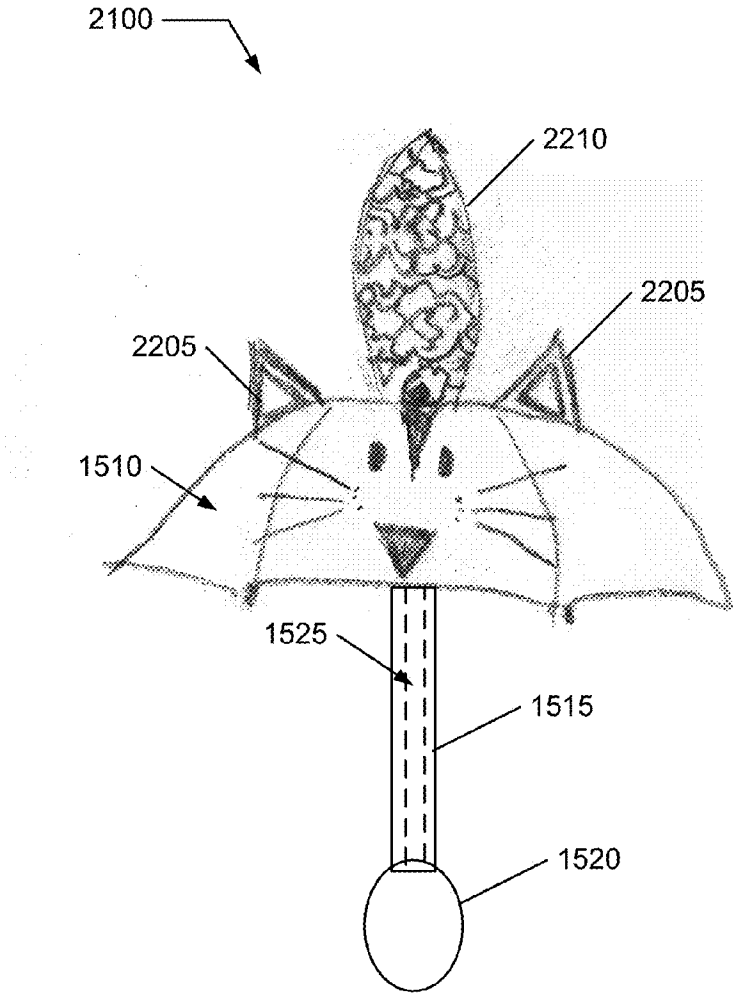
Figure 21:
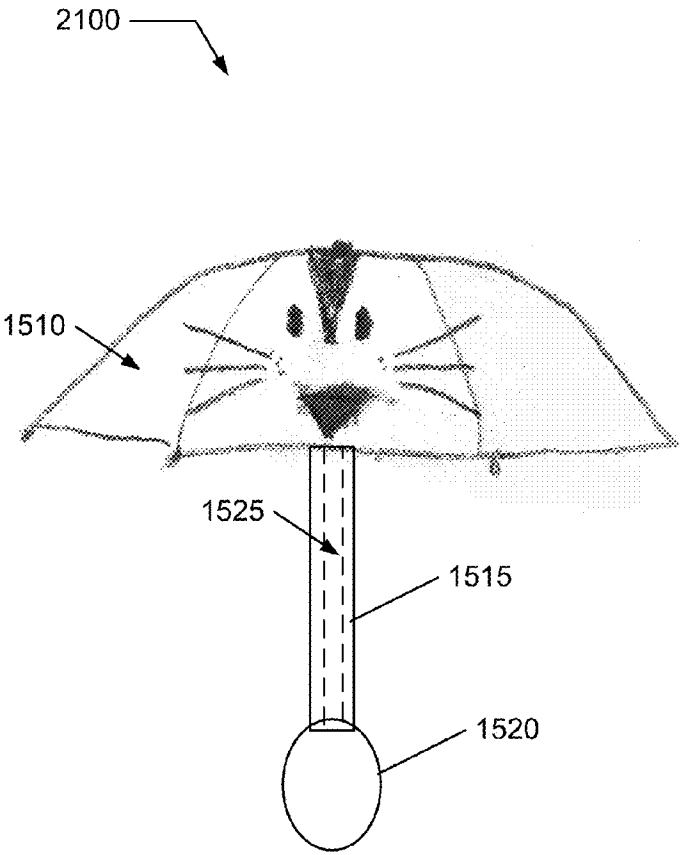

FIG. 21-FIG. 22 illustrate a fox thematic embodiment of a hand-held canopy 2100 having moveable elements including a pair of ears 2205 and a tail 2210. FIG. 21 illustrates hand-held canopy 2100 in an unactuated mode with the moveable elements in an unactuated mode and retracted and FIG. 22 illustrates hand-held canopy 2100 in the actuated mode with ears 2205 and tail 2210 in an actuated mode and extended. Except for the thematic differences and consequent rearrangement and repositioning of actuators, canopy 2100 structurally and operationally corresponds to hand-held canopy 1500, hand-held canopy 1700, and hand-held canopy 1900. As explicitly illustrated in FIG. 21 and FIG. 22, moveable elements are not always in a field of view of a forward observer when in the retracted position.

Figure 23:
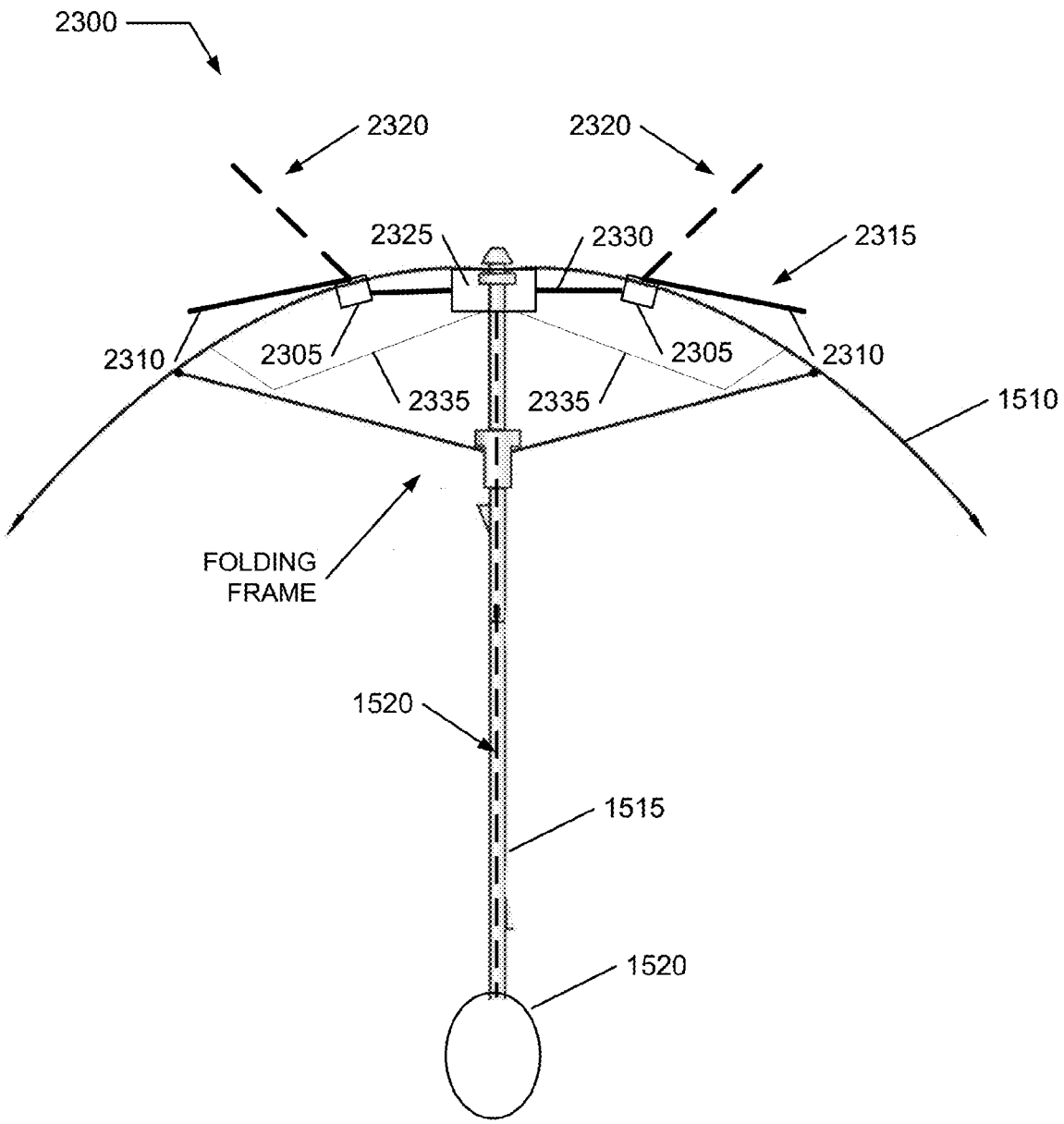

FIG. 23 illustrates an internal cross-section of a hand-held canopy 2300 such as represented by FIG. 15-FIG. 22. In addition to cover 1510, shaft 1515, bladder 1520, and conduit 1525 providing a channel through shaft 1515 to communicate air/pressure changes initiated from bladder 1520, canopy 2300 includes one or more actuators 2305 coupled to cover 1510. Each actuator 2305 includes a moveable element 2310 that has an unactuated position 2315 and an actuated position 2320 (element 2310 biased, preferably self-biased, to unactuated position 2315).

Actuators 2305 are represented in generic form in FIG. 23, the actual implementation being one of the actuators described herein or in the incorporated US patent applications. Similarly, moveable elements 2310 are not depicted with a façade, such as fabric sheath, to simplify this illustration.

Canopy 2300 further includes a distribution manifold 2325 that is coupled to conduit 1520 and distributes air/pressure to actuators 2305 via a flexible conduit/channel 2330. Manifold 2325 may be simply a "T" shaped coupler in some implementations, and in other implementations it may include a refill mechanism as described herein, such as that illustrated in FIG. 6.

For cosmetic purposes, one or more optional internal layers 2335, e.g., flexible material, cloth, fabric, and the like, may be used to conceal actuators 2305, manifold 2325, conduit 2330, and any other components of the actuating mechanism. As discussed herein, the actuating mechanism is operable with canopy cover 1510 in the "open" or "closed" position.

In other respects, canopy 2300 operates in conventional fashion and includes a folding framework that is moveably coupled to shaft 1515. As the framework moves along shaft 1515, cover 1510 closes (folds) and opens (unfolds). When fully opened, folding framework typically includes stretchers and other components to ensure that cover 1510 is taut. Some implementations may include an alternative actuation mechanism of moveable elements coupled to motion of the folding framework relative to shaft 1515, though such systems do not include the independent action of the actuators that may be operated no matter the mode of cover 1510 or operation status of opening/closing cover 1510.

Figure 24:
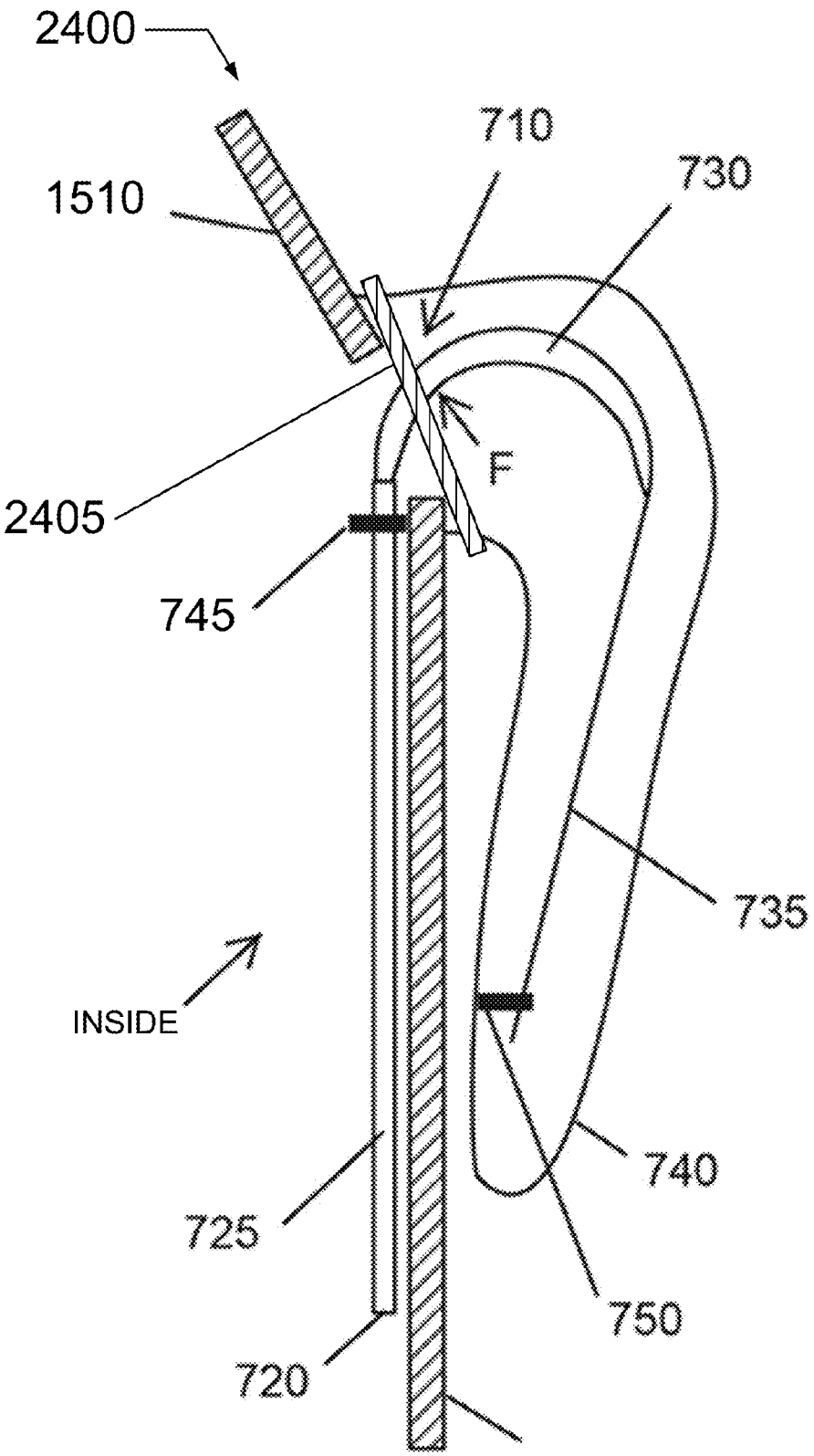

FIG. 24 illustrates a sealing detail for an umbrella implementation of a hand-held canopy 2400, an embodiment of canopy 2300 illustrated in FIG. 24. An important consideration for umbrella implementations includes providing a user with canopy cover 1510 that does not leak. Actuators 2305 of canopy 2300 may be implemented in many different ways. One way includes mounting actuators 2305 inside cover 1510 (such as to an inside surface of cover 1510) and having a portion (or a moveable component) of actuator 2305 extend outside through a slit, gap, or other opening in cover 1510 similar to the embodiment of FIG. 7, adapted for the canopy cover implementation.

Such openings may defeat or reduce operational effectiveness for an umbrella implementation having waterproof material for cover 1510. The openings may allow for leaking inside canopy 2400 and reduce user acceptance of the embodiment. A seal 2405 is disposed at the opening (e.g., around the portion of the actuator extending through the opening) to reduce or eliminate leaking through cover 1510.

Seal 2405 may be implemented as a modified O-ring (modified to operate with cover 1510 and actuator 2305) or other sealing mechanism to inhibit/eliminate water leakage through the opening in cover 1510.

The actuating components have been described in terms of hydraulic systems that employ air. Other systems may employ a fluid for actuation using a closed system lacking bleed mechanisms. In other variations, mechanical linkages and/or levers may be used in place of one or more of the actuating components. For example a lever may operate an air-powered actuating mechanism, or the bellows-type actuating mechanism may trigger a mechanical remote actuator that employs levers and springs to move the moveable elements. In mechanical or hybrid mechanical-hydraulic systems, a moveable flexible cable may couple the actuating mechanism to the remote actuator.

While the container embodiments illustrated in the figures include containers with handles overlying the opening, some implementations of the present invention will not include any handles. In such cases, there may be other structures for concealing the actuating mechanism and/or part of the conduit. However, some embodiments may include one or more unconcealed actuating components, whether it is the actuating mechanism, conduit, or remote actuator. For implementations without a handle, some devices may locate the actuating mechanism in or on some other structure, such as an outer wall, a bottom wall, or other container component. The present invention may be embodied in a range of user-portable canopy types, for example without limitation, purse, hand bag, shoulder bag, backpack, or the like.

The illustrated embodiments have been described in terms of use of non-deformable balloon actuators which use flexible but inelastic layers to form the actuating balloon. In some implementations, the actuating balloon may be both flexible and elastic forming deformable balloon actuators that "inflate" and "deflate" in response to actuating air. In both cases there is some degree of inflation but the elastic walls of the deformable implementation stretch and grow whereas the walls of the deformable implementation do not stretch. The parent application includes descriptions of these types of actuators which may be employed in the present invention.

A preferred implementation of the disclosed embodiments, though not required, includes a discrete actuating assembly. As used herein, a discrete actuating assembly means that the actuating assembly may be removed intact from the associated article of manufacture and maintain operation of the actuating mechanism and associated responsive operation of the air-powered remote actuators.

Throughout the disclosure, various specific thematic configurations are illustrated and described, some associated with specific embodiments or implementations. The various thematic configurations are representative of some of the many different thematic configurations, the disclosed themes may be associated with the various disclosed embodiments, in addition to the undisclosed thematic configurations.

The system and methods above have been described in general terms as an aid to understanding details of preferred embodiments of the present invention. In the description herein, numerous specific details are provided, such as examples of components and/or methods, to provide a thorough understanding of embodiments of the present invention. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. An air-actuated device, comprising:

a canopy article of manufacture configured to be carried by a user, said canopy article of manufacture having a shaft supporting a collapsible frame and a canopy cover coupled to said collapsible frame, said canopy cover including a sheath assembly coupled to an exterior wall of said canopy cover, said sheath assembly having a first outside portion and a second outside portion with said sheath assembly having an unactuated mode and an actuated mode, said unactuated mode providing said sheath assembly overlying said exterior wall displaying said first outside portion while concealing said second outside portion and said actuated mode providing said sheath assembly extending from said canopy article of manufacture and displaying said second outside portion; and a discrete air-powered actuator assembly coupled to said canopy article of manufacture, said discrete air-powered actuator assembling including: a first discrete air bladder coupled to said shaft and having a first exterior wall containing a first bladder volume, said first exterior wall providing a first shape memory repeatedly inflating said first bladder volume after a collapse of said first bladder volume, said first bladder volume including a first capacity for a first quantity of air with said first discrete air bladder including an outlet exiting a portion of said first quantity of air from said first bladder volume when said first exterior wall is collapsed; a second discrete air bladder coupled to both said canopy cover and to said sheath assembly, said second discrete air bladder having a second exterior wall containing a second bladder volume, said second discrete air bladder remotely located relative to said first discrete air bladder, and said second bladder volume including a second capacity for a second quantity of air, said second discrete air bladder including an unactuated mode and an actuated mode, said unactuated mode providing said second discrete air bladder in an unactuated configuration having a proximal portion of said second discrete air bladder positioned relative to a distal portion of said second discrete air bladder, said unactuated configuration defining a separation between said portions equal to a first distance, and said actuated mode providing said second discrete air bladder in an actuated configuration having said separation greater than said first distance, wherein an actuating transition of said second discrete air bladder from said unactuated mode to said actuated mode transitions said sheath assembly from said unactuated mode to said actuated mode and wherein a biased transition of said second discrete air bladder from said actuated mode to said unactuated mode transitions said sheath assembly from said actuated mode to said unactuated mode; and an elongate communication channel, coupled to said outlet and to said second discrete air bladder;

wherein said second discrete air bladder is biased to said unactuated mode; wherein said second discrete air bladder moves from said unactuated configuration to said actuated configuration responsive to air exiting from said first bladder volume; and wherein said second discrete air bladder collapses from said actuated configuration to said unactuated configuration when air exits said second bladder volume.

2. The air-actuated device of claim 1 wherein said canopy article of manufacture includes an umbrella.

3. The air-actuated device of claim 2 wherein said second discrete air bladder includes an elongate clamshell shaped actuator having a first portion overlying a second portion with said first portion coupled to said second portion at a hinging portion, wherein said actuating transition includes an unfolding of said second discrete air bladder about said hinging portion to increase said separation, and wherein said biased transition includes a folding of said second discrete air bladder about said hinging portion to decrease said separation.

4. The air-actuated device of claim 2 wherein said second discrete air bladder includes an elongate bladder extending from said proximal end to said distal end, wherein said unactuated mode includes said second discrete air bladder in a retracted configuration having said distal end rolled to said proximal end, wherein said actuated mode includes said second discrete air bladder in an extended configuration having said distal end at least partially unrolled from said retracted configuration, wherein said transition from said unactuated mode to said actuated mode unrolls said distal end from said proximal end, and wherein said transition from said actuated mode to said unactuated mode rolls said distal end towards said proximal end.

5. The air-actuated device of claim 1 wherein said shaft includes a central channel extending from a proximal end coupled to said bladder to a distal end opposite of said proximal end and wherein said elongate communication channel is disposed within said central channel.

6. The air-actuated device of claim 5 wherein said second discrete air bladder includes an elongate clamshell shaped actuator having a first portion overlying a second portion with said first portion coupled to said second portion at a hinging portion, wherein said actuating transition includes an unfolding of said second discrete air bladder about said hinging portion to increase said separation, and wherein said biased transition includes a folding of said second discrete air bladder about said hinging portion to decrease said separation.

7. The air-actuated device of claim 6 further comprising an air-intake structure coupled to said communication channel, said air-intake structure defining a bidirectional air flow channel between said first bladder and said second bladder and further defining a one way air flow channel from ambient into said bidirectional air flow channel.

8. The air-actuated device of claim 1 wherein said second discrete air bladder includes an elongate clamshell shaped actuator having a first portion overlying a second portion with said first portion coupled to said second portion at a hinging portion, wherein said actuating transition includes an unfolding of said second discrete air bladder about said hinging portion to increase said separation, and wherein said biased transition includes a folding of said second discrete air bladder about said hinging portion to decrease said separation.

9. The air-actuated device of claim 1 wherein said second discrete air bladder includes an elongate bladder extending from said proximal end to said distal end, wherein said unactuated mode includes said second discrete air bladder in a retracted configuration having said distal end rolled to said proximal end, wherein said actuated mode includes said second discrete air bladder in an extended configuration having said distal end at least partially unrolled from said retracted configuration, wherein said transition from said unactuated mode to said actuated mode unrolls said distal end from said proximal end, and wherein said transition from said actuated mode to said unactuated mode rolls said distal end towards said proximal end.

10. The air-actuated device of claim 1 further comprising an air-intake structure coupled to said communication channel, said air-intake structure defining a bidirectional air flow channel between said first bladder and said second bladder and further defining a one way air flow channel from ambient into said bidirectional air flow channel.

11. A method for operating an air-powered actuator system disposed within a canopy article of manufacture, the method comprising the steps of:

(a) collapsing repeatedly a first air cavity defined in a bladder coupled to a central shaft of the canopy article of manufacture, said central shaft supporting a collapsible moveable frame and a canopy cover coupled to said collapsible moveable frame, each collapse expelling a portion of a first quantity of air contained within said first air cavity; and (b) expanding repeatedly said first air cavity; and (c) initiating, responsive to each said collapsing step (a), a transfer of each portion of air towards a second air cavity included within an air-actuated active element coupled to said canopy cover, said active element having a distal portion and a proximal portion moveably coupled to said distal portion wherein said distal portion moves relative to said proximal portion when inflating and deflating, each said portion of air flowing in a flexible conduit connecting said first air cavity to said second air cavity with said portion of air flowing in said flexible conduit beginning a transition of said air-actuated active element from a biasedly-closed unactuated mode towards an open unactuated mode, said unactuated mode having said second air cavity substantially deflated and said second actuated mode having said second air cavity at least partially inflated and extended.

12. The method of claim 11 wherein the canopy article of manufacture includes an umbrella.

13. A collapsible canopy, comprising:

a central shaft supporting a collapsible moveable folding frame, said frame configured to move along said central shaft between an open mode and a closed mode;

a canopy cover coupled to said folding frame;

an actuator coupled through said canopy cover, said actuator having an actuator exterior wall defining an internal actuator cavity accessed through an actuator opening wherein said actuator exterior wall is self-biased to an unactuated mode with said actuator configured to respond to an air pressure differential at said actuator opening to transition to an actuated mode;

a collapsible bladder having a bladder exterior wall defining an internal bladder cavity accessed through a bladder opening wherein said bladder exterior wall includes a collapsible construction producing an output air quantity at said bladder opening when said bladder exterior wall is collapsed; and an elongate communication channel coupled to said bladder opening and to said actuator opening, said elongate communication channel communicating said air pressure differential to said actuator responsive to said output air quantity.

14. The collapsible canopy of claim 13 wherein said canopy cover is configured for an umbrella implementation, wherein said actuator extends through an opening in said canopy cover, further comprising: a seal coupled to said actuator and to said opening.

15. The collapsible canopy of claim 14 wherein said actuator includes a portion extending through said opening in said canopy cover and further comprising a flexible sheath coupled to an outside surface of said canopy cover proximate said opening in said canopy cover, said flexible sheath coupled to said portion of said actuator extending through said opening of said canopy cover.

* * * * *